US008356690B2

(12) United States Patent
Wakatsuki

(10) Patent No.: US 8,356,690 B2
(45) Date of Patent: Jan. 22, 2013

(54) EXHAUST APPARATUS FOR AN INTERNAL COMBUSTION ENGINE

(75) Inventor: Kazutoshi Wakatsuki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/383,507

(22) PCT Filed: Aug. 28, 2009

(86) PCT No.: PCT/JP2009/004227

§ 371 (c)(1),
(2), (4) Date: Jan. 11, 2012

(87) PCT Pub. No.: WO2011/024234

PCT Pub. Date: Mar. 3, 2011

(65) Prior Publication Data

US 2012/0138384 A1 Jun. 7, 2012

(51) Int. Cl.
*F01N 13/08* (2010.01)

(52) U.S. Cl. ..... 181/227; 181/228; 181/212

(58) Field of Classification Search ..... 181/227, 181/212, 228

See application file for complete search history.

(56) References Cited

FOREIGN PATENT DOCUMENTS

| | | |
|---|---|---|
| JP | 54-166624 | 11/1979 |
| JP | Y2-58-23929 | 5/1983 |
| JP | A-59-43916 | 3/1984 |
| JP | A-2-248612 | 10/1990 |
| JP | Y2-5-5213 | 2/1993 |
| JP | U-5-77536 | 10/1993 |
| JP | A-8-303224 | 11/1996 |
| JP | A-2002-89230 | 3/2002 |
| JP | A-2003-41934 | 2/2003 |
| JP | A-2004-204802 | 7/2004 |
| JP | A-2006-46121 | 2/2006 |

OTHER PUBLICATIONS

International Search Report issued in International Application No. PCT/JP2009/004227 on Nov. 24, 2009 (with translation).

*Primary Examiner* — Forrest M Phillips

(74) *Attorney, Agent, or Firm* — Oliff & Berridge, PLC

(57) ABSTRACT

An exhaust apparatus is provided with an exhaust gas pipe for discharging to the atmosphere an exhaust gas discharged from an internal combustion engine. The exhaust gas pipe has an upstream open end connected to the sound deadening device positioned at the upstream side of an exhaust gas discharging direction, and a downstream open end through which the exhaust gas is discharged to the atmosphere. At least one of the exhaust gas upstream side and the exhaust gas downstream side of the exhaust gas pipe has a diameter expansion structure expanded in diameter toward one of the upstream open end and the downstream open end. The exhaust apparatus comprises a plate provided in the diameter expansion structure to be held in opposing relationship with the discharge direction of the exhaust gas and having an open portion formed to pass through the plate in the discharge direction of the exhaust gas.

4 Claims, 19 Drawing Sheets

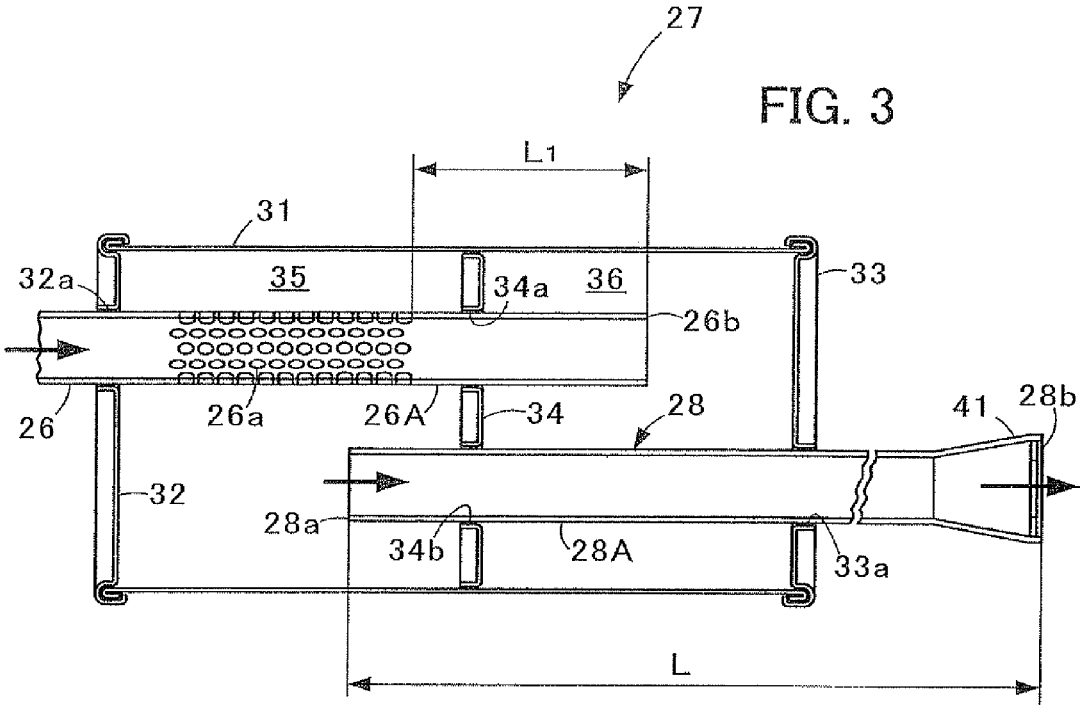
FIG. 3
FIG. 4
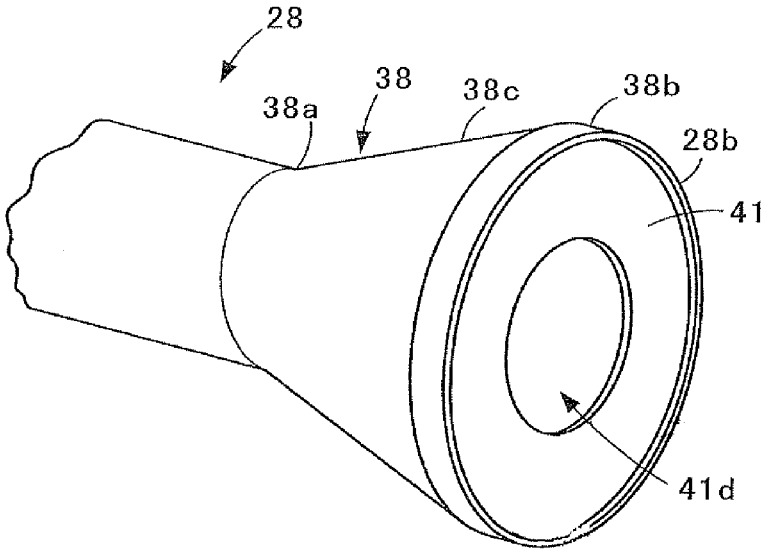

27

EXHAUST APPARATUS FOR AN INTERNAL COMBUSTION ENGINE

TECHNICAL FIELD

This invention relates to an exhaust apparatus for an internal combustion engine, and more particularly to an exhaust apparatus for an internal combustion engine for suppressing the increase of a sound pressure caused by an air column resonance in a tail pipe provided at the most downstream side in the discharging direction of an exhaust gas.

BACKGROUND OF TECHNOLOGY

As an exhaust apparatus for an internal combustion engine to be used by an automotive vehicle, there has so far been known an exhaust apparatus as shown in FIG. 32 (for example see Patent Document 1). In FIG. 32, the known exhaust apparatus 4 is adapted to allow an exhaust gas to be introduced therein after the exhaust gas exhausted from an engine 1 serving as an internal combustion engine passes through an exhaust manifold 2 and is then purified by a catalytic converter 3.

The exhaust apparatus 4 is constituted by a front pipe 5 connected to the catalytic converter 3, a center pipe 6 connected to the front pipe 5, a main muffler 7 connected to the center pipe 6 and serving as a sound deadening device, a tail pipe 8 connected to the main muffler 7, and a sub-muffler 9 connected to the tail pipe 8.

As shown in FIG. 33, the main muffler 7 has an expansion chamber 7*a* for expanding and introducing therein the exhaust gas through small holes 6*a* formed in the center pipe 6, and a resonance chamber 7*b* held in communication with a downstream open end 6*b* of the center pipe 6, so that the exhaust gas introduced into the resonance chamber 7*b* from the downstream open end 6*b* of the center pipe 6 can cause an exhaust gas sound to be muted with a specified frequency by Helmholtz resonator effect.

Here, if the pipe length of the projection portion of the center pipe 6 projecting into the resonance chamber 7*b* is represented by $L_1$ (m), the cross-sectional area of the center pipe 6 is represented by S ($m^2$), the volume of the resonance chamber 7*b* is represented by V ($m^3$), and the speed of sound in air is represented by c (m/s), the resonance frequency $f_n$ (Hz) in the air can be obtained by a following equation (1) in regard to the Helmholtz resonator effect.

$$f_n = \frac{c}{2\pi}\sqrt{\frac{S}{L_1 \cdot V}} \tag{1}$$

As apparent from the equation (1), the resonance frequency can be tuned to a low frequency side by making large the volume V of the resonance chamber 7*b* or otherwise by making long the pipe length $L_1$ of the projection portion of the center pipe 6, while can be tuned to a high frequency side by making small the volume V of the resonance chamber 7*b* or otherwise by making short the pipe length $L_1$ of the projection portion of the center pipe 6.

The sub-muffler 9 is adapted to suppress the sound pressure from being increased with the column air resonance generated in the tail pipe 8 in response to the pipe length of the tail pipe 8 by the pulsation of the exhaust gas during the operation of the engine 1.

In general, the tail pipe 8 having an upstream open end 8*a* and a downstream open end 8*b* at the respective upstream and downstream sides in the exhaustion direction of the exhaust gas is constructed to allow incident waves to be reflected at the upstream open end 8*a* and the downstream open end 8*b*. The incident waves are caused by the pulsation of the exhaust gas during the operation of the engine 1 to be incident upon the upstream open end 8*a* and the downstream open end 8*b*, thereby generating an air column resonance with a wavelength. The air column resonance has a basic component of a frequency with a half wavelength equal to the pipe length of the tail pipe 8, and has a wavelength which is natural number times the half wavelength.

More specifically, the wavelength $\lambda_1$ of the air column resonance of a basic vibration (primary component) is roughly double the pipe length L of the tail pipe 8, while the wavelength $\lambda_2$ of the air column resonance of the secondary component is roughly one time the pipe length L of the tail pipe 8. The wavelength $\lambda_3$ of the air column resonance of the third component is ⅔ times the pipe length L of the tail pipe 8. Therefore, the tail pipe 8 has therein a standing wave which is formed to have respective nodes of sound pressures at the upstream open end 8*a* and the downstream open end 8*b*.

The column air resonance frequency "fa" can be represented by a following equation (2).

$$fa = \frac{c}{2L}n \tag{2}$$

Here, "c" represents the speed of sound (m/s), "L" represents the pipe length of the tail pipe (m/s), and "n" represents a degree. As apparent from the equation (2), the speed of sound "c" has a constant value responsive to an ambient temperature.

It is therefore understood that the longer the pipe length L of the tail pipe 8 becomes, nearer the air column frequency "fa" moves to the low frequency side, thereby making it easy to give rise to a noise problem caused by the air column resonance of the exhaust gas sound in the low frequency area.

For example, if the speed of sound "c" is assumed to be 400 m/s, the primary component "$f_1$" and the secondary component "$f_2$" of the exhaust gas sound caused by the air column resonance respectively become 1661 Hz and 333.3 Hz in the case of the pipe length "L" of the tail pipe 8 being 1.2 m. On the other hand, the primary component "$f_1$" and the secondary component "$f_2$" of the exhaust gas sound caused by the air column resonance respectively become 66.7 Hz and 133.3 Hz in the case of the pipe length "L" of the tail pipe 8 being 3.0 m. It is therefore understood that the longer the pipe length L of the tail pipe 8 becomes, nearer the air column frequency "fa" moves to the low frequency side.

The frequency "fe(Hz)" of the exhaust gas pulsation of the engine 1 is given by a following equation (3).

$$fe = \frac{Ne}{60} \times \frac{N}{2} \tag{3}$$

Here, "Ne" is an engine rotation number (rpm), and "N" is a number of cylinders of the engine (natural number). The sound pressure level (dB) of the exhaust gas sound becomes remarkably high for the primary component "$f_1$" of the exhaust gas sound at the time of the air column resonance generated in response to a specified engine rotation number "Ne". Further, the sound pressure level (dB) of the exhaust gas sound also becomes remarkably high for the secondary component "$f_2$" of the exhaust gas sound.

For example, if the speed of sound "c" is assumed to be 400 m/s, the 4-cylider engine is represented by N=4, so that there is caused an air column resonance having a primary component "$f_1$" of the frequency 66.7 Hz when the engine rotation number "Ne" becomes 2,000 rpm, while another air column resonance having a secondary component "$f_2$" of the frequency 133.3 Hz is caused when the engine rotation number "Ne" becomes 4,000 rpm in the case of the pipe length "L" of the tail pipe 8 being 3.0 m.

Especially in the case that the air column resonance is generated in the low frequency area below 100 Hz of the frequency of the exhaust gas pulsation of the engine 1, there is caused a problem in noise. For example when the air column resonance is generated in the tail pipe 8 at a low engine rotation number of 2,000 rpm, the exhaust gas sound is transmitted to the passenger room of the vehicle, thereby leading to generating a muffled sound and thus to giving an unpleasant feeling to a driver.

For this purpose, there is provided a sub-muffler 9 smaller in volume than the main muffler 7 at the optimum position of the tail pipe 8 in view of an abdominal portion having a high sound pressure of a standing wave generated by the air column resonance, thereby preventing the air column resonance from being generated.

Therefore, for example when the speed of sound "c" is 400 m/s, and the pipe length "L" of the tail pipe 8 is 3.0 m with no sub-muffler 9, there is caused an air column resonance below 100 Hz of the frequency of the exhaust gas pulsation of the engine 1 (below 3,000 rpm of the engine rotation number "Ne") as previously mentioned. In contrast, when the sub-muffler 9 is supported on the tail pipe 8, and the pipe length "L" of the tail pipe 8 extending rearwardly of the sub-muffler 9 is 1.5 m, the primary component "$f_1$" of the exhaust gas sound caused by the air column resonance is 133.3 Hz, and the engine rotation number "Ne" is 4,000 rpm, thereby leading to causing the air column frequency "fa" to move to the high frequency side.

For this reason, the sub-muffler 9 supported on the tail pipe 8 can suppress the muffled sound in the passenger room at the engine low rotation number, viz., 2,000 rpm of the engine rotation number of the engine 1, thereby preventing an unpleasant feeling from being given to the driver.

On the other hand, it is considered to reduce the production cost and the weight of the exhaust apparatus 4 by eliminating the previously mentioned sub-muffler 9. As one of the measures, it is considered to tune the resonance frequency of the main muffler 7 connected to the upstream open end 8*a* of the tail pipe 8 with the frequency of the air column resonance to mute the exhaust gas sound of the air column resonance of the tail pipe 8 in the resonance chamber of the main muffler 7.

More specifically, it may be considered that in accordance with the equation (1), the volume "V" of the resonance chamber 7*b* is increased, and the length "$L_1$" of the projection portion of the center pipe 6 is lengthened to conduct the tuning of the resonance frequency of the resonance chamber 7*b* toward the low frequency side, thereby preliminarily muting in the resonance chamber 7*b* the air column resonance to be generated in the tail pipe 8.

PRIOR ART DOCUMENTS

Patent Documents

Patent Document 1: Patent Publication No. 2006-46121

SUMMARY OF INVENTION

Problems to be Solved by Invention

However, the conventional exhaust apparatus for the engine 1 encounters such a problem that such a construction to reduce the air column resonance of the tail pipe 8 with the resonance chamber 7*b* of the main muffler 7 requires the volume of the resonance chamber 7*b* to be made large, thereby leading to requiring the main muffler 7 to be made large in size. The main muffler 7 made large in size leads to such a problem as increasing not only the weight of the exhaust apparatus 4 but also the production cost of the exhaust apparatus 4.

Further, the accelerator pedal released during the speed reduction operation of the vehicle results in the fact that only an exhaust gas stream is generated with the gas amount discharged into the exhaust apparatus 4 being rapidly decreased, thereby leading to making small the pressure of air to be introduced into the resonance chamber 7*b*.

For this reason, it is impossible to obtain the amount of air sufficient to achieve the Helmholtz resonance effect in the resonance chamber 7*b*, thereby leading to making it difficult to suppress the air column resonance from being generated in the tail pipe 8. Especially due to the rapid decrease of the engine rotation number of the engine 1 during the speed reduction operation of the vehicle, there is caused a muffled sound in the passenger room of the vehicle at around the low engine rotation number of 2,000 rpm (the primary component "$f_1$" of the exhaust gas sound caused by the air column resonance), thereby resulting in giving an unpleasant feeling to the driver.

It is therefore required to provide the sub-muffler 9 at the optimum position on the tail pipe 8 to suppress the sound pressure caused by the air column resonance of the tail pipe 8 from being increased. As a consequence, there is caused such a problem that the weight of the exhaust apparatus 4 is increased, and the production cost of the exhaust apparatus 4 is also increased.

The present invention has been made to solve the previously mentioned problem, and has an object to provide an exhaust apparatus, which require neither sub-muffler supported on the tail pipe nor sound deadening device having a resonance chamber with a large volume at the upstream open end of the tail pipe, and which can suppress the sound pressure level caused by the air column resonance of the tail pipe from being increased, and can reduce the weight, the production cost and the installation space of the exhaust apparatus.

Means for Solving the Problem

To solve the previously mentioned problem, the exhaust apparatus for the internal combustion engine according to the present invention comprises; an exhaust gas pipe having one end portion formed with an upstream open end positioned at an upstream side of exhaust gas discharged from an internal combustion engine and connected with a sound deadening device, and the other end portion formed with a downstream open end positioned at a downstream side of the exhaust gas to discharge the exhaust gas to the atmosphere, a diameter expansion structure formed on at least one of the exhaust gas upstream side and the exhaust gas downstream side of the exhaust gas pipe to be expanded in diameter toward one of the upstream open end and the downstream open end, and a plate provided in the diameter expansion structure in opposing relationship with the discharge direction of the exhaust gas and having an open portion passing through the plate in the discharge direction of the exhaust gas and a closed portion closing the exhaust gas pipe, the plate being arranged to generate an open end reflection wave at the open portion and a closed end reflection wave at the closed portion in such a manner that the open end reflection wave and the closed end reflection wave interferes with each other.

The exhaust gas apparatus for the internal combustion engine is constructed to have a diameter expansion structure formed on at least one of the exhaust gas upstream side and the exhaust gas downstream side of the exhaust gas pipe to be expanded in diameter toward one of the upstream open end and the downstream open end, and a plate provided in the diameter expansion structure in opposing relationship with the discharge direction of the exhaust gas and having an open portion passing through the plate in the discharge direction of the exhaust gas and a closed portion closing the exhaust gas pipe, the plate being arranged to generate an open end reflection wave at the open portion and a closed end reflection wave at the closed portion in such a manner that the open end reflection wave and the closed end reflection wave interferes with each other. The exhaust gas apparatus thus constructed makes it possible to suppress the internal reflection with the aid of the diameter expansion structure, the internal reflection being caused by the exhaust gas to be introduced into the exhaust gas pipe while being pulsated by the operation of the internal combustion engine. When the frequency of the exhaust gas sound is matched with the frequency of the air column resonance in the exhaust gas pipe, the open end reflection wave generated at the open portion in the same phase as that of the incident wave interferes with and cancels the closed end reflection wave generated at the closed portion in the phase 180 degrees different from that of the incident wave, thereby making it possible to suppress the sound pressure level of the exhaust gas sound from being increased and to suppress the air column resonance from being generated in the exhaust gas pipe.

The fact that the air column resonance can be suppressed from being generated in the exhaust gas pipe and the sound pressure level of the exhaust gas sound can be suppressed from being increased leads to the fact that there is no muffled sound to be generated in the passenger room at the low engine rotation time of the internal combustion engine. Especially, the muffled sound has caused a conventional problem.

As a consequence, there is no need to make large in scale a sound deadening device corresponding the main muffler needed for the conventional exhaust apparatus as well as to provide a sub-muffler in the exhaust gas pipe, thereby making it possible to decrease the weight, the production cost and the installation space of the exhaust apparatus. The apparatus according to the present invention is useful for whole exhaust apparatuses for the internal combustion engine.

In the exhaust apparatus thus constructed, the diameter expansion structure provided on at least one of the exhaust gas upstream side and the exhaust gas downstream side of the exhaust gas pipe preferably has an exponential shape expanded in diameter toward the open end to draw an exponential curve.

The exhaust apparatus constructed as in the above has the diameter expansion structure provided on at least one of the exhaust gas upstream side and the exhaust gas downstream side of the exhaust gas pipe having an exponential shape portion that is expanded in diameter toward the open end to draw an exponential curve, so that the incident wave is by no means reflected at any one of the exhaust gas upstream side and the exhaust gas downstream side of the exhaust gas pipe, and can reach the plate without fail. As a result, the open end reflection wave generated at the open portion reliably interferes with and cancels the closed end reflection wave generated at the closed portion, thereby making it possible to suppress the air column resonance caused by the reflection waves of the exhaust gas sound from being generated. Here, the term "exponential curve" is intended to mean a curve drawn by an exponential function having one and the other variable numbers, the latter of which is defined by the former.

In the exhaust apparatus thus constructed, the opening area of the open portion is preferably set at one third the total area of the open portion and the closed portion of the plate.

Since the opening area of the open portion in the exhaust apparatus constructed as in the above is set at one third the total area of the open portion and the closed portion of the plate, the reflection ratio of the sound wave on the plate is 0.5. This means that the open end reflection wave and the closed end reflection wave can be generated at a ratio of 1 and 1, and that the reflection waves are same in amount but 180 degrees different in phase, thereby making it possible for the reflection waves to interfere with and cancel each other. As a result, the reducing effect of the sound pressure level can be heightened to the highest level.

Effects of Invention

The present invention can provide an exhaust apparatus, which require neither sub-muffler to be supported on the tail pipe nor sound deadening device to be provided with a resonance chamber having a large volume at the upstream open end of the tail pipe, and which can suppress the sound pressure level caused by the air column resonance of the tail pipe from being increased, and which can suppress the sound pressure level caused by the air column resonance of the tail pipe from being increased, and can reduce the weight, the production cost and the installation space of the exhaust apparatus.

BRIEF EXPLANATION OF DRAWINGS

FIG. 3 shows the first embodiment of the exhaust apparatus for the internal combustion engine according to the present invention, and is a longitudinally cross-sectioned view of the muffler which is cross-sectioned on a plane passing the center axis of the tail pipe and a center axis of a center pipe shown in FIG. 2.

FIG. 4 shows the first embodiment of the exhaust apparatus for the internal combustion engine according to the present invention, and is a perspective view showing part of the tail pipe which is seen from the downstream open end of the tail pipe.

EMBODIMENTS FOR CARRYING OUT INVENTION

The first to seventh embodiments of the exhaust apparatus for the internal combustion engine according to the present invention will be described hereinafter with reference to the accompanying drawings.

First Embodiment

FIGS. 1 to 13 are views showing a first embodiment of the exhaust apparatus for the internal combustion engine according to the present invention.

Figure 1:
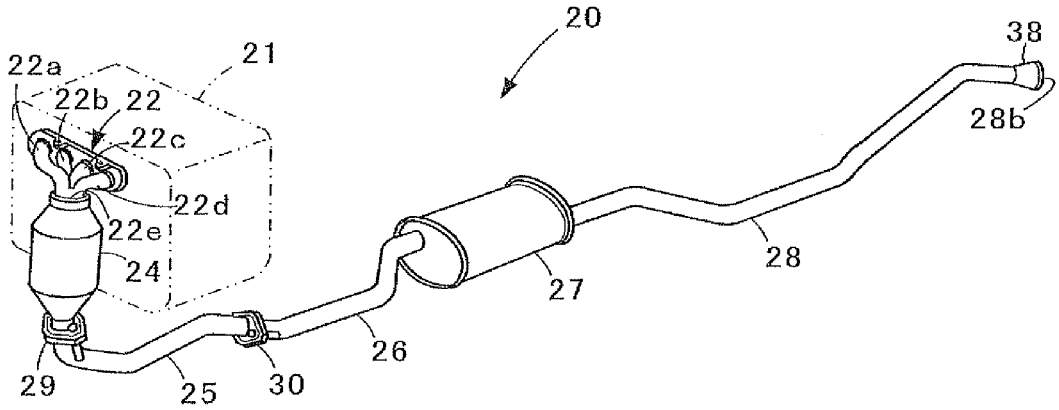
FIG. 1 shows a first embodiment of an exhaust apparatus for an internal combustion engine according to the present invention, and is a perspective view showing the construction of an exhaust gas system for the internal combustion engine.

The exhaust apparatus 20 for the internal combustion engine according to the present invention is shown in FIG. 1 as being applied to a straight 4-cylinder engine 21 serving as an internal combustion engine, and as being connected to an exhaust gas manifold 22 connected to the engine 21. The exhaust apparatus 20 is adapted to purify an exhaust gas discharged from the engine 21, and then to discharge the exhaust gas into the atmosphere while suppressing exhaust gas sound.

The engine 21 is not limited to the above straight 4-cylinder engine, and may be replaced by a straight 3-cylinder engine, a straight 5-cylinder engine, and other engines each having more cylinders. The engine 21 may be replaced by a V-engine having more than 3-cylinders respectively mounted on the right and left banks divided.

The exhaust gas manifold 22 is constituted by four exhaust gas branch pipes 22*a*, 22*b*, 22*c*, 22*d* respectively connected to exhaust ports formed to be held in communication with the first to fourth cylinders of the engine 21, and an exhaust gas collecting pipe 22*e* constructed to collect the downstream sides of the exhaust gas branch pipes 22*a*, 22*b*, 22*c*, 22*d*, so that the exhaust gas discharged from the cylinders of the engine 21 can be introduced into the exhaust gas collecting pipe 22*e* through the exhaust gas branch pipes 22*a*, 22*b*, 22*c*, 22*d*.

The exhaust apparatus 20 is provided with a catalytic converter 24, a cylindrical front pipe 25, a cylindrical center pipe 26, a muffler 27 serving as a sound deadening device, and a tail pipe 28 serving as a cylindrical exhaust gas pipe. The exhaust apparatus 20 is installed at the downstream side of the exhaust gas discharging direction of the engine 21 in such a manner that the exhaust apparatus 20 is resiliently hanging from the floor of the vehicle. The term "upstream side" indicates an upstream side in the discharging direction of the exhaust gas, while the term "downstream side" indicates a downstream side in the discharging direction of the exhaust gas.

The upstream end of the catalytic converter 24 is connected to the downstream end of the exhaust gas collecting pipe 22*e*, while the downstream end of the catalytic converter 24 is connected to the front pipe 25 through a universal joint 29. The catalytic converter 24 is constructed by a case housing therein a honeycomb substrate or a granular activated alumina-made carrier deposited with catalysts such as platinum and palladium to perform reduction of Nox, and oxidization of CO, HC.

The universal joint 29 is constructed by a spherical joint such as a ball joint and the like to allow the catalytic converter 24 and the front pipe 25 to be relatively displaced with each other. The downstream end of the front pipe 25 is connected to the upstream end of the center pipe 26 through a universal joint 30. The universal joint 30 is constructed by a spherical joint such as a ball joint and the like to allow the front pipe 25 and the center pipe 26 to be relatively displaced with each other.

The downstream end of the center pipe 26 is connected to the muffler 27 adapted to mute the exhaust gas sound.

Figure 2:
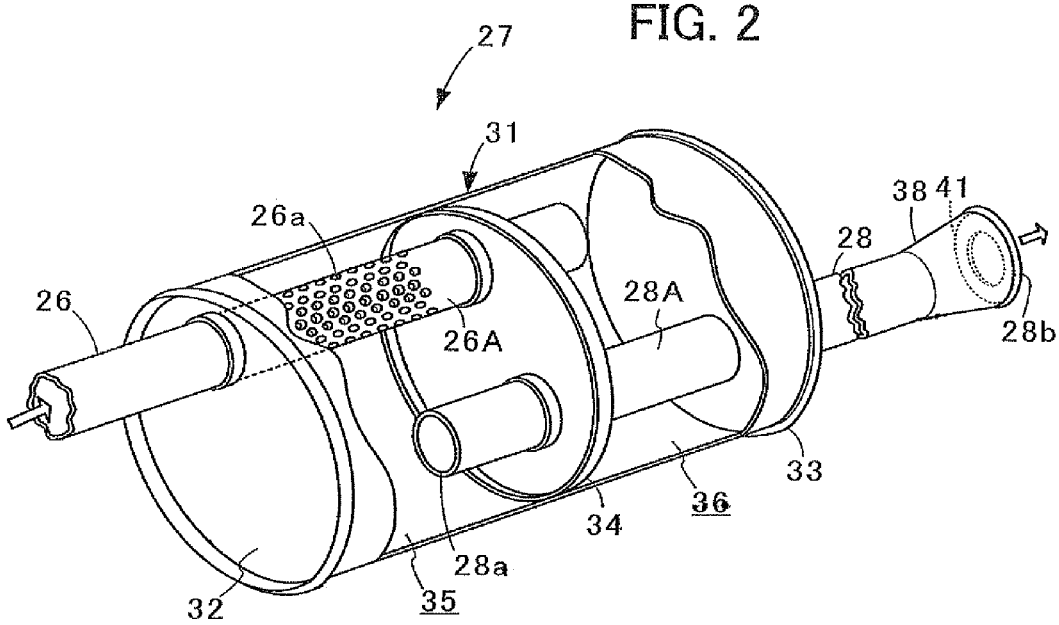
FIG. 2 shows the first embodiment of the exhaust apparatus for the internal combustion engine according to the present invention, and is a perspective view of a muffler connected to a tail pipe and showing part of the muffler fragmentarily cross-sectioned.

As shown in FIGS. 2 and 3, the muffler 27 is provided with an outer shell 31 formed in a cylindrical shape, end plates 32, 33 for closing the both axial ends of the outer shell 31, and a partition plate 34 intervening between the end plate 32 and the end plate 33. The outer shell 31, and the end plates 32, 33 collectively constitute a sound deadening body. The muffler 27 according to the present first embodiment constitutes a sound deadening device forming part of the exhaust apparatus for the internal combustion engine according to the present invention.

The partition plate 34 provided in the outer shell 31 is adapted to divide the outer shell 31 into an expansion chamber 35 for expanding the exhaust gas in the outer shell 31, and a resonance chamber 36 for muting the exhaust gas sound with a specified frequency under the Helmholtz resonance effect. The end plate 32 and the partition plate 34 are formed with through bores 32*a*, 34*a*, respectively. The through bores 32*a*, 34*a* allow the downstream end portion of the center pipe 26, viz., an inlet pipe portion 26A forming part of the center pipe 26 to pass therethrough and extend in the muffler 27.

The inlet pipe portion 26A is supported on the end plate 32 and the partition plate 34 and accommodated in the expansion chamber 35 and the resonance chamber 36 in such a manner that the downstream open end 26*b* is open to the resonance chamber 36.

The inlet pipe portion 26A is formed with a plurality of small through bores 26*a* formed to be arranged in the axial direction (the discharging direction of the exhaust gas) and the circumferential direction of the inlet pipe portion 26A, so that the inner chamber of the inlet pipe portion 26A is held in communication with the expansion chamber 35 through the small through bores 26*a*.

Therefore, the exhaust gas to be introduced into the muffler 27 through the inlet pipe portion 26A of the center pipe 26 is introduced into the expansion chamber 35 through the small through bores 26*a* and into the resonance chamber 36 through the downstream open end 26*b* of the inlet pipe portion 26A.

The exhaust gas sound of the exhaust gas with a specified frequency (Hz) can be muted by the Helmholtz resonance effect when the exhaust gas is introduced into the resonance chamber 36.

If the length of the projection portion of the inlet pipe portion 26A projecting into the resonance chamber 36 is represented by $L_1$(m), the cross-sectional area of the inlet pipe portion 26A is represented by S($m^2$), the volume of the resonance chamber 36 is represented by V($m^3$), and the speed of sound in the air is represented by c(m/s), the resonance frequency $f_b$(Hz) can be given by the following equation regarding Helmholtz resonance.

$$f_b = \frac{c}{2\pi}\sqrt{\frac{S}{L_1 \cdot V}} \tag{4}$$

As apparent from the equation (4), the fact that the volume V of the resonance chamber 36 is made small, the length $L_1$ of the projection portion of the inlet pipe portion 26A is made short, and the cross-sectional area S of the inlet pipe portion 26A is made large makes it possible to tune the resonance frequency toward its high frequency side. On the other hand, the fact that the volume V of the resonance chamber 36 is made large, the length $L_1$ of the projection portion of the inlet pipe portion 26A is made long, and the cross-sectional area S of the inlet pipe portion 26A is made small makes it possible to tune the resonance frequency toward its low frequency side.

On the other hand, the partition plate 34 and the end plate 33 are respectively formed with the through bores 34*b*, 33*a* which allow the upstream end portion of the tail pipe 28, viz., an outlet pipe portion 28A forming part of the tail pipe 28 accommodated in the muffler 27 to pass therethrough.

The tail pipe 28 is made of a cylindrical pipe. The upstream end portion of the outlet pipe portion 28A has an upstream open end 28*a*, while the downstream end portion of the tail pipe 28 has a downstream open end 28*b*. As shown in FIG. 3, the downstream open end 28*b* of the downstream end portion of the tail pipe 28 is spaced apart from the upstream open end 28*a* of the upstream end portion of the outlet pipe portion 28A by the distance L. The outlet pipe portion 28A is connected to the muffler 27 in such a manner that the outlet pipe portion 28A passes through the through bores 34*b*, 33*a* with the upstream open end 28*a* being open in the expansion chamber 35.

Figure 5:
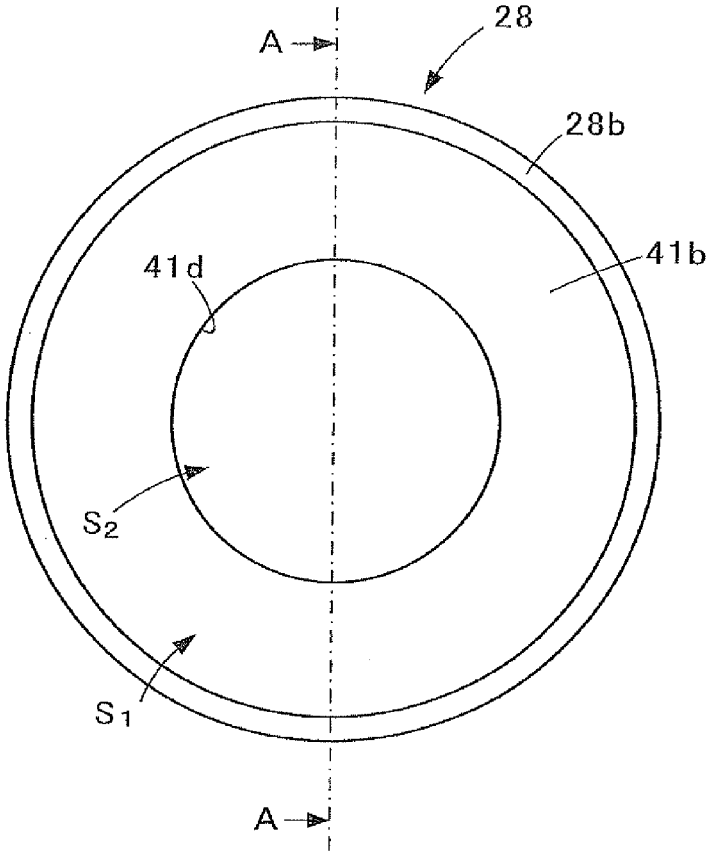
FIG. 5 shows the first embodiment of the exhaust apparatus for the internal combustion engine according to the present invention, and is a front elevational view of the tail pipe which is seen from the downstream open end of the tail pipe.
Figure 6:
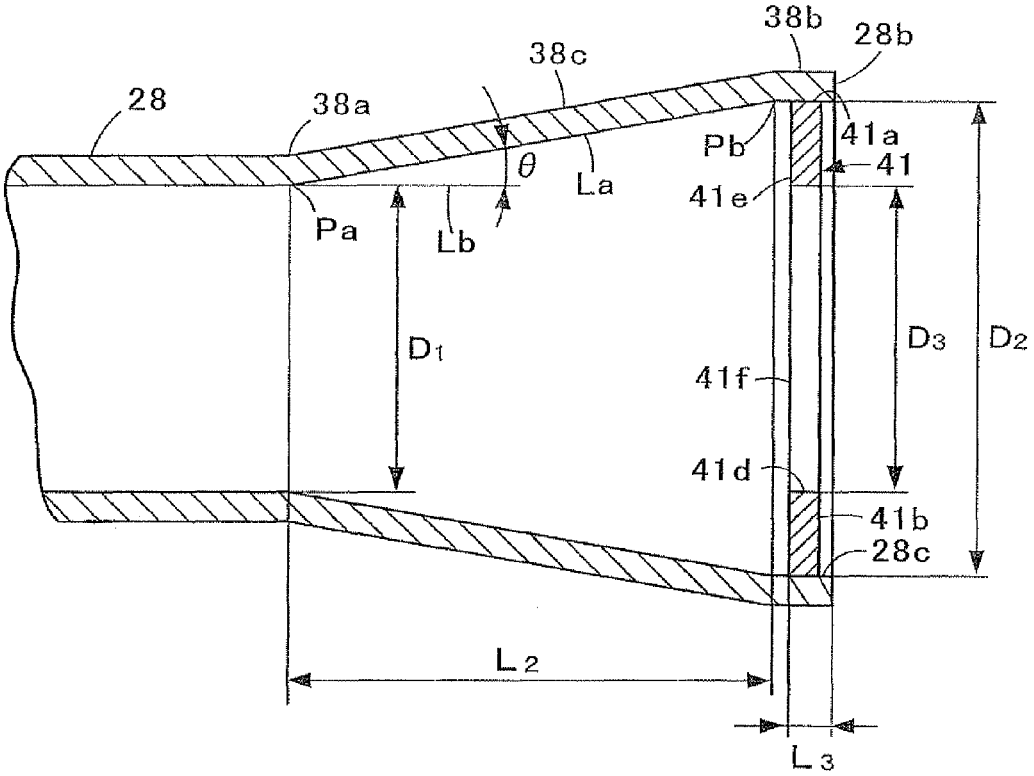
FIG. 6 shows the first embodiment of the exhaust apparatus for the internal combustion engine according to the present invention, and is a cross-sectional view taken along and seen from the line A-A in FIG. 5.
Figure 7:
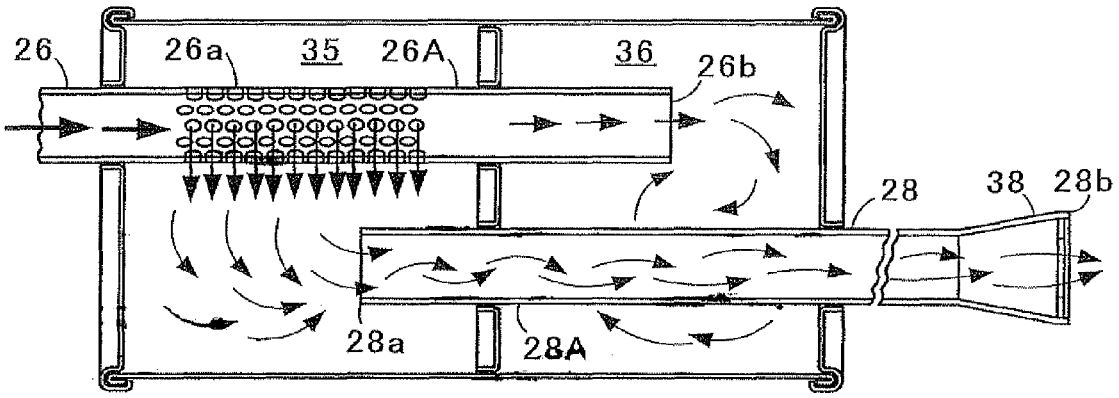
FIG. 7 shows the first embodiment of the exhaust apparatus for the internal combustion engine according to the present invention, and shows the flow of the exhaust gas in the muffler and the tail pipe.

As shown in FIGS. 4, 5 and 6, the tail pipe 28 is provided at its downstream side in the exhaust direction of the exhaust gas with a diameter expansion structure 38 expanded in diameter toward the downstream open end 28*b*, and a plate 41 in opposing relationship with the exhaust direction of the exhaust gas.

As shown in FIG. 6, the diameter expansion structure 38 comprises a base end portion 38*a*, a forward end portion 38*b*, and a conical portion 38*c*. The base end portion 38*a* has an inner diameter $D_1$ equal to the inner diameter of the tail pipe 28, and is connected with the tail pipe 28. The forward end portion 38*b* has an inner diameter $D_2$ larger than the inner diameter $D_1$ of the base end portion 38*a*, and is in opposing relationship with the base end portion 38*a*. The conical portion 38*c* is formed to extend between the base end portion 38*a* and the forward end portion 38*b* to have an inner diameter gradually increased from the inner diameter $D_1$ to the inner diameter $D_2$, viz., from the base end portion 38*a* to the forward end portion 38*b*.

The conical portion 38*c* is formed at an angle θ between the straight line La connecting the point Pa on the inner peripheral surface of the base end portion 38*a* with the point Pb on the inner peripheral surface of the forward end portion 38*b*, and the straight line Lb passing through the point Pa and extending in the axial direction of the tail pipe 28. Therefore, the distance $L_2$ in the axial direction of the tail pipe 28 between the point Pa and the point Pb can be given by the following equation (5).

$$L_2 = \frac{D_2 - D_1}{2\tan\theta} \tag{5}$$

It is generally known that the sound wave passing through a pipe having a constant cross-sectional area advances in a plane wave, while if the cross-sectional area of the pipe is changed, there is caused a reflection of the sound wave in response to the changed cross-sectional area of the pipe.

However, for the pipe which is changed in cross-sectional area and has a changed cross-section portion like the conical portion 38*c*, the change of the plane wave of the exhaust gas sound can be suppressed, and thus the reflection in the conical portion 38*c* can be suppressed when the exhaust gas sound is incident to the inside of the tail pipe 28, and the incident wave passes through the conical portion 38*c*.

Here, the inner diameter $D_1$, the inner diameter $D_2$, and the angle θ can be suitably selected based on the dimensions of the vehicle design, the simulation, and the data such as experiment and experience values that has so far been applied to the exhaust apparatus 20 according to the present first embodiment. While the above description has been explained by raising the straight line La connecting the point Pa on the inner peripheral surface of the base end portion 38*a* with the point Pb on the peripheral surface of the forward end portion 38*b*, the above straight line La connecting the point Pa on the inner peripheral surface of the base end portion 38*a* and the point Pb on the peripheral surface of the forward end portion 38*b* may be constituted by a curve having a large curvature radius formed by a gentle concave shape.

The plate 41 has an outer peripheral portion 41*a* having an outer diameter almost the same as the inner diameter $D_2$ of the forward end portion 38*b* of the diameter expansion structure 38, and a side surface portion 41*b* positioned in opposing relationship with the exhaust direction of the exhaust gas flowing in the tail pipe 28. The side surface portion. 41*b* of the plate 41 is formed with a circular through bore having a diameter $D_3$ almost the same as the inner diameter $D_1$ of the base end portion 38*a* of the diameter expansion structure 38, the through bore constituting an open portion 41*d* of the plate 41 according to the present invention. The side surface portion 41*b* is provided with the open portion 41*d*, and a closed portion 41*e* constituted by a portion other than the open portion 41*d*. The exhaust gas can be discharged to the atmosphere through the open portion 41*d*.

Here, the plate 41 is provided to be in opposing relationship with the exhaust direction of the exhaust gas flowing in the tail pipe 28. More concretely, the plate 41 is secured to the tail pipe 28 in perpendicular relationship with the axial direction of the tail pipe 28. The plate 41 is secured to the tail pipe 28 in such a manner that the outer peripheral portion 41*a* of the plate 41 and the inner peripheral portion 28*c* of the tail pipe 28 are held in tight contact with and thus hermetically sealed with each other. Here, the methods of securing the plate 41 to the tail pipe 28 are preferably securing methods such as a jointing method, a pressurizing method and the like. In lieu of these securing methods, the method of securing the plate 41 to the tail pipe 28 may be integrally formed by a drawing process and the like.

The plate 41 is attached to the tail pipe 28 with the outer peripheral portion 41*a* being secured to the inner peripheral portion 28*c* of the tail pipe 28 in such a manner that the reflection surface portion 41*f* of the side surface portion 41*b* at the upstream side of the exhaust gas discharging direction is spaced apart from the downstream open end 28*b* of the tail pipe 28 by the distance $L_3$. The reflection surface portion 41*f* of the side surface portion 41*b* is positioned to have the exhaust gas sound passed through the diameter expansion structure 38 reach the reflection surface portion 41*f* while being maintained in the plane wave state.

The side surface portion 41*b* of the plate 41 serves to cause what is called an open end reflection at the open portion 41*d* against the incident wave indent to the inside of the tail pipe 28, while causing what is called a closed end reflection at the closed end portion 41*e* against the incident wave indent to the inside of the tail pipe 28. This means that the reflection surface portion 41*f* of the plate 41 can cause these reflections of the exhaust gas sound.

In this case, the open end reflection and the closed end reflection respectively distributed at the open portion 41*d* and the closed portion 41*e* cancel each other, thereby resulting in reducing the sound pressure level of the reflection sound by the mutually interfering effect of the open end reflection and the closed end reflection. Further, the reflection surface portion 41*f* has a surface to reflect the incident wave and to generate the reflection wave. The reflection surface portion 41*f* is thus constituted by the open portion 41*d* and the closed portion 41*e*.

Further in order to obtain an optimum sound deadening effect to the reflection sound, the opening area $S_2$ ($m^2$) of the open portion 41*d* and the total area $S_1$ ($m^2$) of the side surface portion 41*b* including the open portion 41*d* of the plate 41 as shown in FIG. 5 are designed to meet the following equation (6).

$$S_2 \approx \frac{1}{3}S_1 \tag{6}$$

The equation (6) can be obtained by the following method. For obtaining an optimum sound deadening effect to the reflection sound, the following logic is known. Here, if the reflection rate of the particle speed of the exhaust gas sound at the open portion 41*d* is represented by $Rv_1$, the permeability of the particle speed of the exhaust gas sound at the open portion 41*d* is represented by $Tv_1$, and the reflection rate of the particle speed of the exhaust gas sound at the closed portion 41*e* is represented by $Rv_2$, it is required to equal the energies produced at the open portion 41*d* and the closed portion 41*e*, which are respectively positive and negative, and thus opposite in phase, resulting from the addition of ($Rv_1$+$Tv_1$) and $Rv_2$. In other words, it is required for the equation ($Rv_1$+$Tv_1$)+$Rv_2$=0 to be established.

Here, if an inherent acoustic impedance of a medium in the tail pipe 28 is represented by $Z_1$, and an inherent acoustic impedance of a medium in the neighborhood of the open portion 41*d* of the plate 41 in the tail pipe 28 is represented by $Z_2$, an inherent acoustic impedance of a medium in the neighborhood of the downstream open end 28*b* outside of the tail pipe 28, i.e., in the atmosphere is represented by $Z_3$, and an area opposing an opening area $S_2$ at the open side to the atmosphere is represented by $S_3$, the reflection rate $Rv_1$, the permeability $Tv_1$, and the reflection rate $Rv_2$ are given by the following equations (7), (8) and (9).

$$Rv_1 = \frac{Z_3S_3 - Z_2S_2}{Z_2S_2 + Z_3S_3} \tag{7}$$

$$Tv_1 = \frac{2Z_2S_2}{Z_1S_1 + Z_2S_2} \tag{8}$$

$$Rv_2 = \frac{Z_2S_2 - Z_1S_1}{Z_1S_1 + Z_2S_2} \tag{9}$$

Therefore, the equation ($Rv_1$+$Tv_1$)+$Rv_2$=0 is given as follows.

$$\frac{Z_3S_3 - Z_2S_2}{Z_2S_2 + Z_3S_3} \times \frac{2Z_2S_2}{Z_1S_1 + Z_2S_2} + \frac{Z_2S_2 - Z_1S_1}{Z_1S_1 + Z_2S_2} = 0 \tag{10}$$

Here, the inherent acoustic impedance can be represented by the product of the density of the medium ρ ($Kg/m^3$) and the speed of sound c (m/s), thereby resulting in $Z_1=\rho_1c_1$, $Z_2=\rho_2c_2$, $Z_3=\rho_3c_3$. The medium $\rho_1$ and the speed of sound $c_1$ in the tail pipe 28, the medium $\rho_2$ in the neighborhood of the open portion 41*d* of the plate 41 in the tail pipe 28, and the medium $\rho_3$ in the neighborhood of the downstream open end 28*b* outside of the tail pipe 28 are defined by the exhaust gas. This exhaust gas can be occasionally air when the engine 21 is operated in the state with no fuel injection. When the exhaust gas and the air exist in the tail pipe 28, the equation $\rho_1c_1=\rho_2c_2=\rho_3c_3$ can be obtained, thereby resulting in $Z_1=Z_2=Z_3$. The equation (10) is represented by the following equation (11).

$$S_1 = S_2 + \frac{2S_2(S_3 - S_2)}{S_2 + S_3} \tag{11}$$

Here, the area $S_3$ is open to the atmosphere and thus becomes ∞, i.e., infinite. When the area $S_3$ in the equation (11) is calculated with ∞, the previous equation (6) can be obtained.

Next, explanation will be directed hereinafter to the operation of the exhaust apparatus 20 and the reason of generating the air column resonance.

When the engine 21 upstream of the exhaust apparatus 20 is started to be operated, the exhaust gas emitted from each of the cylinders is introduced from the exhaust gas manifold 22 into the catalytic converter 24 by which the reduction of Nox and the oxidations of CO and HC are carried out.

The exhaust gas purified and discharged by the catalytic converter 24 is introduced into the muffler 27 of the exhaust apparatus 20 through the front pipe 25 and the center pipe 26. The exhaust gas introduced into the muffler 27 is, as shown by arrows in FIG. 7, introduced into the expansion chamber 35 through the small through bores 26*a* of the inlet pipe portion 26A, and then introduced into the resonance chamber 36 through the downstream open end 26*b* of the inlet pipe portion 26A.

The exhaust gas introduced into the expansion chamber 35 is introduced into the tail pipe 28 through the upstream open end 28*a* of the outlet pipe portion 28A, and then discharged to the atmosphere through the open portion 41*d* of the plate 41. As has been explained in the above, the plate 41 is provided at the forward end portion 38*b* of the diameter expansion structure 38 in the downstream open end 28*b* of the tail pipe 28. The plate 41 provided at the downstream open end 28*b* has an outer diameter $D_2$ larger than the inner diameter $D_1$ of the tail pipe 28 due to the diameter expansion structure 38. The open portion 41*d* of the plate 41 is formed to have an inner diameter $D_3$ equal to the inner diameter $D_1$ of the tail pipe 28. This results in the fact that the exhaust gas can smoothly pass through the open portion 41*d* while the exhaust gas is passing through the open portion 41*d*, thereby making it possible to suppress the back pressure of the exhaust gas from being increased.

The exhaust gas pulsation excited by each of the cylinders of the engine 21 exploded during the operation of the engine 21 causes the exhaust gas sound having frequencies (Hz) varied in response to the rotation number (rpm) of the engine 21 to be generated from each of the cylinders of the engine 21. The frequencies of exhaust gas sound are increased as the rotation numbers of the engine 21 are increased. The exhaust gas sound is incident to the inlet pipe portion 26A of the muffler 27 through the exhaust gas manifold 22, the catalytic converter 24, the front pipe 25, and the center pipe 26 in the exhaust gas serving as a medium.

The exhaust gas sound incident to the inlet pipe portion 26A is introduced into the expansion chamber 35 through the small through bores 26*a* of the inlet pipe portion 26A, and expanded to cause the sound pressure level of the exhaust gas sound to be reduced in all the frequency band areas. The exhaust gas sound incident to the inlet pipe portion 26A is then introduced into the resonance chamber 36 through the downstream open end 26*b*. In the exhaust gas sound introduced into the resonance chamber 36, the sound pressure level of the exhaust gas sound having a specific frequency set by the Helmholtz resonance can be decreased.

The exhaust gas sound incident to the inside of the expansion chamber 35 is incident to the inside of the tail pipe 28 to become an incident wave which is in turn reflected by the plate 41 at the downstream open end 28*b* of the tail pipe 28 to become a reflection wave. Here, the diameter expansion structure 38 formed to be expanded in diameter toward the downstream end 28*b* causes the total area $S_1$ of the side surface portion 41*b* including the open portion 41*d* of the plate 41 to become larger than the cross-sectional area of the tail pipe 28. The diameter expansion structure 38 having the conical portion 38*c* makes it possible to suppress the exhaust gas sound from being reflected in the diameter expansion structure 38.

It is therefore to be noted that the exhaust gas sound incident to the inside of the tail pipe 28 can reliably reach the reflection surface portion 41*f* of the plate 41 without being reflected while passing through the diameter expansion structure 38.

The reflection wave generated by the open end reflection and the reflection wave generated by the closed end reflection cause an interference to cancel each other. The reflection wave generated by the open end reflection and the reflection wave generated by the closed end reflection are further reflected at the upstream open end 28*a* of the tail pipe 28 to advance toward the downstream open end 28*b* similarly to the incident wave previously mentioned and to be reflected again similarly to the incident wave at the plate 41. It is thus to be noted that the reflections thus caused are repeated, thereby generating a standing wave.

Further, it may be considered that at the boundary of both the media having the same medium like the open end of a pipe there is fundamentally caused no reflection, thereby allowing the sound wave to penetrate through the boundary of the media since the media are the same in medium. However, the exhaust gas sound advancing in the pipe like the tail pipe 28 having a cross-sectional area dimension sufficiently small to the wavelength of the exhaust gas sound becomes a plane wave made of a thin and thick wave, and thus reflects at the downstream open end 28*b* and the upstream open end 28*a*.

The reason why the open end reflection is caused at the downstream open end 28*b* will be able to be explained with the following description. The pressure of the exhaust gas flowing in the tail pipe 28 is high, while the atmospheric pressure outside the downstream open end 28*b* of the tail pipe 28 is lower than the pressure of the exhaust gas flowing in the tail pipe 28. The incident wave is violently discharged out into the atmosphere through the downstream open end 28*b*, thereby causing a low-pressure portion where the pressure of the exhaust gas inside of the downstream open end 28*b* become low. This is because the low pressure-portion starts to move in the tail pipe 28 toward the upstream open end 28*a*.

This means that the reflection wave becomes a plane wave opposite in direction to the incident wave and advances in an opposite direction to the incident wave. The reason why the reflection wave is generated at the upstream open end 28*a* is the same as that of the reflection wave generated as previously mentioned.

The incident wave moving toward the open portion 41*d* of the downstream open end 28*b* is interfered with the first reflection wave moving in the direction away from the open portion 41*d* of the downstream open end 28*b*. Further, the first reflection wave is reflected at the opening of the upstream open end 28*a* to become a second reflection wave moving toward the open end 41*d*. The second reflection wave, the first reflection wave, and the incident wave are repeatedly generated and interfered with each other between the upstream open end 28*a* and the downstream open end 28*b*.

The reflection waves and the incident wave thus repeatedly generated leads to causing a standing wave between the opening of the upstream open end 28*a* and the open portion 41*d* of the downstream open end 28*b*.

When there exists a special relationship between the pipe length L of the tail pipe 28 and the wavelength $\lambda$ of the standing wave, the standing wave is generated with the opening of the upstream open end 28*a* of the tail pipe 28 and the open portion 41*d* of the downstream open end 28*b* each forming an abdominal portion of the particle speed. Under these conditions, there is generated an air column resonance having a remarkably large amplitude. The air column resonance has a fundamental frequency with a half wavelength equal to the pipe length L of the tail pipe 28. The air column resonance is generated with the frequency having several times the natural number of the fundamental frequency, and with the wavelength having a length obtained by dividing the fundamental wave by the natural number, so that the sound pressure is remarkably increased and thus causes noises.

Figure 8:
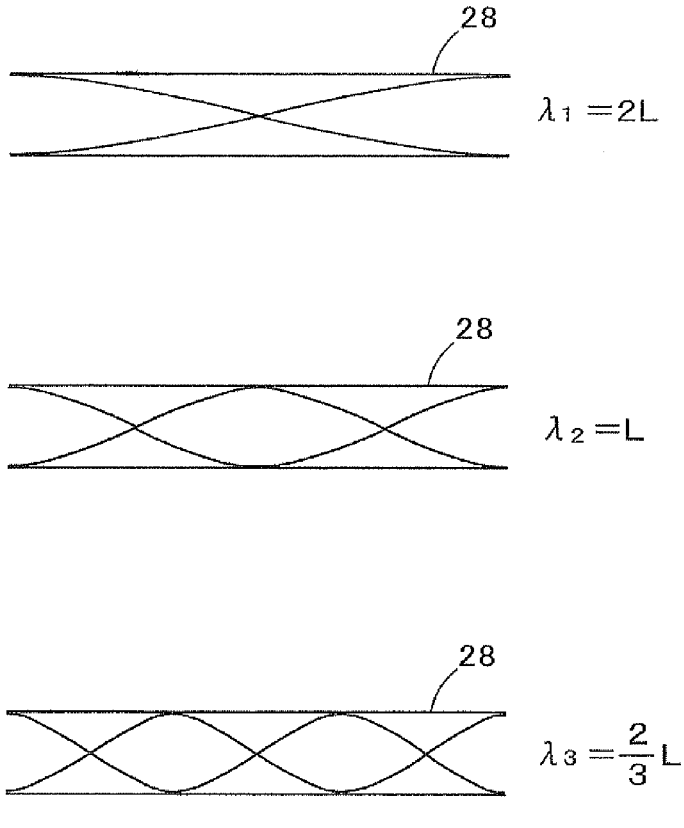
FIG. 8 shows the first embodiment of the exhaust apparatus for the internal combustion engine according to the present invention, and shows views for explaining the standing waves of air column resonances each caused by a closed end reflection generated in the tail pipe, and each schematically showing a particle speed distribution having a particle speed on a vertical axis, and a position of the tail pipe on a horizontal axis.

FIG. 8 shows views for explaining the standing waves of air column resonances on particle speed distributions. The wavelength $\lambda_1$ of the air column resonance of a primary component constituted by a fundamental vibration of the exhaust gas sound is approximately double the pipe length L of the tail pipe 28, while the wavelength $\lambda_2$ of the air column resonance of a second component double the fundamental vibration of the exhaust gas sound is approximately one time the pipe length L of the tail pipe 28. Further, the wavelength $\lambda_3$ of the air column resonance of a tertiary component three times the fundamental vibration of the exhaust gas sound is approximately ⅔ times the pipe length L of the tail pipe 28. As apparent from FIG. 8, the standing wave forms an abdominal portion of the particle speed and thus has a maximum value in the particle speed at each of the upstream open end 28*a* and the downstream open end 28*b* of the tail pipe 28.

The particle speed distributions of the standing wave of the primary to tertiary components of the exhaust gas sounds have abdominal portions and node portions opposite to each other as shown in FIG. 8. This means that each of the upstream open end 28*a* and the downstream open end 28*b* forms a node portion of the sound pressure and thus forms the sound pressure of zero.

Figure 9:
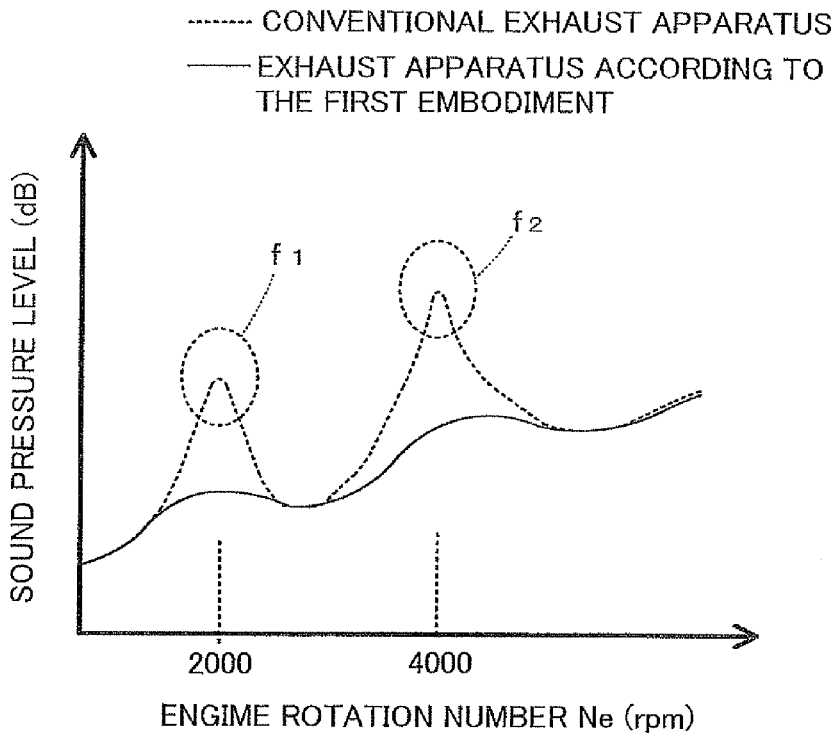
FIG. 9 shows the first embodiment of the exhaust apparatus for the internal combustion engine according to the present invention, and is a view showing the relationship between the sound pressure level of the tail pipe and the rotation number of the engine.

As shown in FIG. 9, the sound pressure level (dB) of the exhaust gas sound is increased at the engine rotation number Ne corresponding to the resonance frequency (Hz) of each of the primary component $f_1$, and the secondary component $f_2$ as the engine rotation number Ne (rpm) is increased.

Here, if the speed of sound is represented by "c" (m/s), the length of the tail pipe 28 is represented by "L" (in), and the degree is represented by "n", the air column resonance frequency "fc" (Hz) can be given by a following equation (12).

$$fc = \frac{c}{2L}n \tag{12}$$

If the speed of sound "c" is 400 m/s, and the length L of the tail pipe 28 is 3.0 m, the primary component $f_1$ of the exhaust gas sound and the secondary component $f_2$ of the exhaust gas sound caused by the air column resonance of the tail pipe 28 in accordance with the above equation (12) are 66.7 Hz and 133.3 Hz, respectively. This means that the sound pressure levels (dB) of the exhaust gas sounds become high at the primary component $f_1$ and the secondary component $f_2$ of the resonance frequencies by the air column resonances in response to the rotation numbers of the engine 21.

In the first embodiment, the engine 21 is made of four-cylinders so that in the above equation (3), "N" becomes four, i.e., N=4. When the engine rotation number Ne is 2,000 rpm, the sound pressure level (dB) of the exhaust gas sound at the primary component $f_1$ of the resonance frequency is increased by the air column resonance. When the engine rotation number Ne is 4,000 rpm, the sound pressure level (dB) of the exhaust gas sound at the secondary component $f_2$ of the resonance frequency is also increased by the air column resonance.

Especially in the low speed rotation area of the low frequency 100 Hz or below like the air column resonance of the primary component $f_1$ of the exhaust gas sound, there is caused in the passenger room a muffled sound that may give an unpleasant feeling to the driver. The engine rotation number Ne for the air column resonance frequency of the tertiary component is 6,000 rpm, while the engine rotation number Ne for the air column resonance frequency of the fourth component is 8,000 rpm. In this way, there is a possibility that the air column resonance frequencies of the multi-stage components are generated. The possible noises caused by the air column resonance frequencies of the multi-stage components are not so unpleasant to the driver due to the even higher noises generated by the engine 21. Therefore, the multi-stage components larger than the tertiary component are not shown in FIG. 9.

The exhaust apparatus according to the first embodiment can reliably suppress the sound pressure (dB) from being increased by the air column resonance that is caused in the conventional tail pipe when the engine rotation number Ne is around the low rotation number of 2,000 rpm (primary component $f_1$) or around the medium rotation number of 4,000 rpm (secondary component $f_2$).

Next, the reason why the increase of the sound pressure level caused by the air column resonance can be suppressed will be explained in more detail hereinafter.

As previously mentioned, the open end reflection is caused at the open portion 41*d* against an incident wave incident to the inside of the tail pipe 28, and the closed end reflection is caused at the closed portion 41*e* against the incident wave incident to the inside of the tail pipe 28. In other words, the open end reflection and the closed end reflection are respectively caused at the reflection surface 41*f* of the plate 41.

More concretely, the reflection waves are distributed to two reflection waves different in phase against the incident waves incident to the inside of the tail pipe 28. The distributed reflection waves include a reflection wave by the open end reflection caused at the open portion 41*d* of the plate 41 occupying approximately 33% of the total area $S_1$ of the side surface portion 41*b* including the open portion 41*d* of the plate 41, and an additional reflection wave differing 180 degrees in phase against the incident wave and caused by the closed end reflection at the closed portion 41*e* of the side surface portion 41*b* of the plate 41 occupying approximately 67% of the total area $S_1$ previously mentioned. The reflection waves distributed and caused by the open end reflection at the open portion 41*d* and the closed end reflection at the closed portion 41*e* of the side surface portion 41*b* cancel each other. As a consequence, the reflection sounds can be deadened, thereby suppressing the increase of the sound pressure level (dB) caused by the air column resonance.

In this case, in order to obtain the most preferable sound deadening effect of the reflection sound, the reflection rate Rp of the exhaust gas sound incident to the plate 41 is set at 0.5 to cause the distribution ratio between the open end reflection and the closed end reflection to become half and half. To have the reflection rate Rp set at 0.5, the open portion 41*d* is shown in FIG. 5 to be formed to meet S2 □ (⅓)S1 in the equation (6) showing the relationship between the opening area S2 (m2) of the open portion 41*d* and the total area $S_1$ ($m^2$) of the side surface portion 41*b* including the open portion 41*d*.

Figure 10:
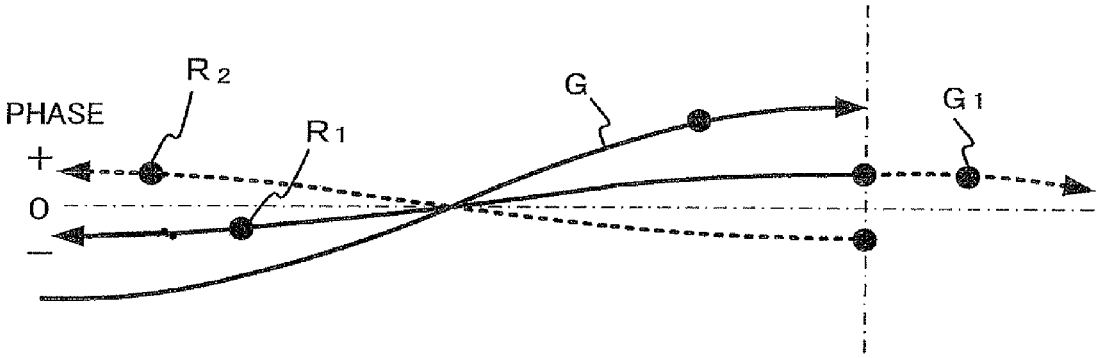
FIG. 10 shows the first embodiment of the exhaust apparatus for the internal combustion engine according to the present invention, and is a view for explaining a state in which an incident wave "G" is distributed into reflected waves "$R_1$" and "R2" by using a particle speed distribution schematically shown to have a particle speed on a vertical axis and a position of the tail pipe on a horizontal axis.

With reference to FIG. 10, the explanation will be made hereinafter about the open end reflection, viz., the case that the incident wave G of the exhaust gas sound caused by the exhaust gas pulsation at the time of the operation of the engine 21 is incident to the inside of the tail pipe 28 and has a half wave equal to the pipe length L of the tail pipe 28.

When the frequency of the incident wave G is matched with the air column resonance frequency of the tail pipe 28, part of the incident wave G becomes a transmission wave G1 to be invaded to the atmosphere through the open portion 41*d* of the plate 41 provided at the downstream end 28*b* of the tail pipe 28 as shown in FIG. 10. On the other hand, the above open end reflection is caused at the open portion 41*d* of the plate 41, thereby causing the incident wave G to become a reflection wave $R_1$ shown in the solid line and to advance in the direction away from the plate 41 as shown in FIG. 10.

The reflection wave $R_1$ is the same in phase as the incident wave G. More specifically, the exhaust gas and air mass dense or sparse transmitted in the narrow air column formed by the tail pipe is rapidly expanded immediately when the exhaust gas and air mass reaches a boundary position between the open portion 41*d* and the large space of the atmosphere. The exhaust gas and air mass thus expanded becomes sparse in place of dense caused by the inertia thereof. The sparse exhaust gas and air mass then forms a new wave source that becomes a reflection wave $R_1$ to return in the air column in the direction in which the incident wave advances immediately before. In this way, the dense exhaust gas and air mass is changed into the sparse exhaust gas and air mass, while the sparse exhaust gas and air mass is changed into dense exhaust gas and air mass. This means that the phase of the incident wave G becomes the phase of the reflection wave $R_1$, thereby causing the reflection wave $R_1$ to become the same in phase as the incident wave G.

In this way, the reflection wave $R_1$ is the same in phase as the incident wave G, and thus the reflection wave $R_1$ is overlapped on the same line with the incident wave G. For convenience of the explanation about the reflection wave $R_1$ and the incident wave G, FIG. 10 shows the reflection wave $R_1$ displaced with respect to the incident wave G.

On the other hand, the above closed end reflection is caused at the closed portion 41*e* of the plate 41 provided at the downstream end 28*b* of the tail pipe 28, thereby causing the incident wave G to become a reflection wave $R_2$ shown in the broken line and to advance in the direction away from the plate 41.

The reflection wave $R_2$ is opposite in phase with respect to the incident wave G, and thus differs 180 degrees in phase with respect to the reflection wave $R_1$. More specifically, the exhaust gas and air mass dense or sparse transmitted in the narrow air column of the tail pipe 28 collides with the wall surface of the closed portion 41*e* to rebound while the dense exhaust gas and air mass dense remains dense, and the sparse exhaust gas and air mass dense remains sparse, thereby causing the incident wave G to become opposite in phase. As a consequence, the incident wave G becomes opposite in phase to the reflection wave $R_2$, so that the reflection wave $R_2$ becomes opposite in phase to the incident wave G.

In this way, the incident wave G and the reflection wave $R_2$ are opposite in phase to each other. Naturally, the reflection wave $R_2$ is symmetrical with the incident wave G across the horizontal line showing the phase zero. For convenience of the explanation about the reflection waves $R_1$ and $R_2$, FIG. 10 shows the reflection wave $R_2$ displaced with respect to the reflection wave $R_1$ to make the reflection wave $R_2$ in symmetrical relationship with the reflection wave $R_1$ across the horizontal line showing the phase zero.

The reflection wave $R_1$ and the reflection wave $R_2$ are opposite in phase to each other but the same in particle speed as each other. This means that the reflection wave $R_1$ and the reflection wave $R_2$ function to interfere with and thus cancel each other, thereby causing no air column resonance in the air column of the tail pipe 28. As a consequence, the primary component $f_1$ of the exhaust gas sound caused by the air column resonance as shown in broken line in FIG. 9 can be suppressed, thereby causing the sound pressure level of the exhaust gas sound to drastically be reduced as shown in the solid line in FIG. 9.

The air column resonance of the secondary component $f_2$ is performed based on the primary component $f_1$ fundamental in vibration for this air column resonance. In the air column resonance of the secondary component $f_2$, the reflection wave reflected at the downstream open end 28*b* of the tail pipe 28 is distributed to a reflection wave $R_1$ caused by the open portion 41*d* to be the same in phase as the incident wave G and a reflection wave $R_2$ caused by the closed portion 41*e* to be different 180 degrees in phase from the incident wave G, so that the reflection wave $R_1$ and the reflection wave $R_2$ interfere with and cancel each other in a similar manner shown in FIG. 10. As a consequence, the secondary component $f_2$, shown in broken line, of the exhaust gas sound caused by the air column resonance is suppressed in solid line as shown in FIG. 9, thereby making it possible to drastically reduce the sound pressure level of the exhaust gas sound.

Next, explanation will be made about the incident wave G which is incident to the inside of the tail pipe 28 by the pulsation of the exhaust gas at the time of operating the engine 21, the incident wave G having a ¼ wavelength equal to the pipe length L of the tail pipe 28.

Figure 11:
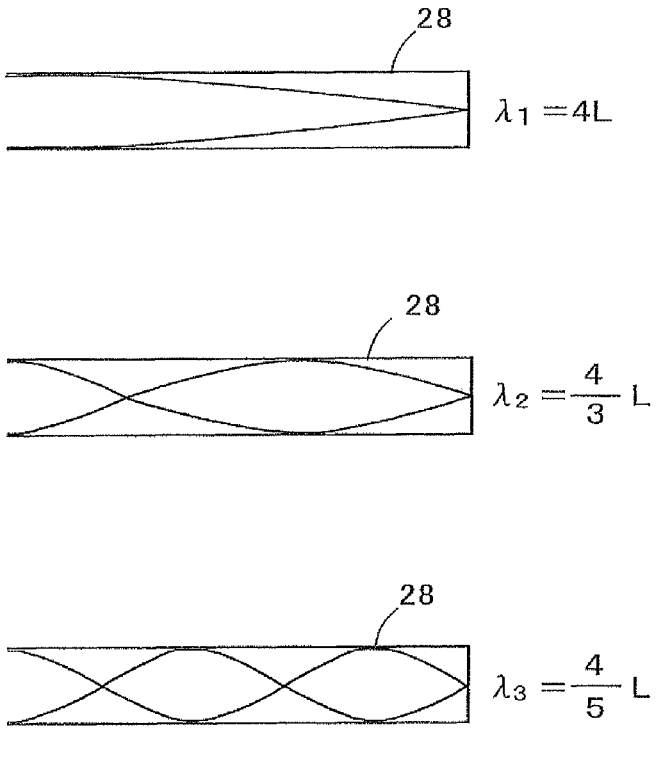
FIG. 11 shows the first embodiment of the exhaust apparatus for the internal combustion engine according to the present invention, and shows additional views for explaining the standing waves of air column resonances each on a particle speed distribution, each of the air column resonances being caused by a closed end reflection generated in the tail pipe, and the particle speed distribution being schematically shown to have a particle speed on a vertical axis and a position of the tail pipe on a horizontal axis.

As shown in FIG. 8, the open end reflection is performed to generate the air column resonance resonated at a basic frequency having a half wavelength equal to the pipe length L of the tail pipe 28. The air column resonance thus generated has a wavelength obtained by dividing the basic wavelength by a natural number. In contrast, the closed end reflection is performed as shown in FIG. 11 to generate the air column resonance resonated at a basic frequency having a ¼ wavelength equal to the pipe length L of the tail pipe 28. The air column resonance thus generated has a wavelength obtained by dividing the basic frequency by an uneven number. The incident wave incident to the inside of the tail pipe 28 through the upstream open end 28*a* of the tail pipe 28 is reflected at the closed end to form a reflection wave having a phase 180 degrees different from the incident wave.

More concretely, as shown in FIG. 11, the wavelength $\lambda_1$ of the primary component of the air column resonance having a basic vibration is approximately four times the pipe length L of the tail pipe 28, while the wavelength $\lambda_2$ of the secondary component of the air column resonance is approximately four third times the pipe length L of the tail pipe 28. Further, the wavelength $\lambda_3$ of the tertiary component of the air column resonance is approximately four fifth times the pipe length L of the tail pipe 28. Therefore, it is possible to generate a standing wave with the closed end being a node portion of the particle speed, and with the open end being an abdominal portion of the particle speed.

The sound pressure distributions in the standing wave of the primary to tertiary components of the air column resonance have the abdominal portions and node portions of the particle speed opposite to each other, and the standing wave can be generated to have the closed end and the open end respectively produce the abdominal portion and the node portion of the sound pressure.

The increase of the sound pressure level (dB) of the exhaust gas sound caused by the resonance frequency occurs in the case of the incident wave G having a ¼ wavelength equal to the length L of the tail pipe 28 in the manner the same as the case of the incident wave G having a ½ wavelength equal to the length L of the tail pipe 28.

More specifically, the sound pressure level (dB) of the exhaust gas sound is increased at the engine rotation number Ne corresponding to each of the resonance frequencies (Hz) of the primary component $f_1$ and the secondary component $f_2$ in response to the increase of the engine rotation number Ne (rpm) similarly to the graph shown in FIG. 9.

Here, when the speed of sound is "c" (m/s), the length of the tail pipe 28 is L (m), and the degree is "n", the air column resonance frequency fd (Hz) is represented by the following equation (13).

$$fd = \frac{c}{4L}(2n-1) \tag{13}$$

When the speed of sound "c" is 400 m/s, and the length of the tail pipe 28 is 3.0 m, the primary component $f_1$ and the secondary component $f_2$ of the exhaust gas sound caused by the air column resonance in the tail pipe 28 are respectively 33.3 Hz and 100 Hz which are obtained on the basis of the above equation (13). The sound pressure levels (dB) of the exhaust gas sound are heightened for the primary component $f_1$ and the secondary component $f_2$ caused by the air column resonances corresponding to the rotation numbers of the engine 21.

The present embodiment is constructed by an engine 21 with four cylinders, so that in the previous equation (3), N is equal to 4 (N=4). The sound pressure level (dB) of the exhaust gas sound caused by the air column resonance of the primary component $f_1$ is increased at the time of the engine rotation number Ne being 1,000 rpm, while the sound pressure level (dB) of the exhaust gas sound caused by the air column resonance of the secondary component $f_2$ is also increased at the time of the engine rotation number Ne being 3,000 rpm.

In the first embodiment, when the incident wave G with the ¼ wavelength equal to the pipe length L of the tail pipe 28 is incident to the inside of the tail pipe 28 by the exhaust gas pulsation at the time of the operation of the engine 21, the frequency of the incident wave G comes to be matched with the frequency of the air column resonance caused in the tail pipe 28.

At this time, the reflection wave reflected by the downstream open end 28*b* of the tail pipe 28 is distributed to the reflection wave $R_1$ of the open end reflection caused by the open portion 41*d* the same in phase as the incident wave G, and the reflection wave $R_2$ of the closed end reflection caused by the closed portion 41*e* 180 degrees different in phase from the incident wave G.

The reflection wave $R_1$ and the reflection wave $R_2$ are opposite in phase to each other, but the same in size of particle speed, so that the reflection wave $R_1$ and the reflection wave $R_2$ interferes with each other and cancel each other, thereby resulting in the primary component $f_1$ of the exhaust gas sound caused by the air column resonance being suppressed and thus drastically decreasing the sound pressure level of the exhaust gas sound.

Further, for the air column resonance of the secondary component $f_2$ having the primary component $f_1$ as a fundamental vibration, the reflection wave reflected at the downstream open end 28*b* of the tail pipe 28 is distributed to the reflection wave $R_1$ of the open end reflection caused by the open portion 41*d* of the plate 41 the same in phase as the incident wave G, and the reflection wave $R_2$ of the closed end reflection caused by the closed portion 41*e* of the plate 41 180 degrees different in phase from the incident wave G as in the case shown in FIG. 10. At this time, the reflection wave $R_1$ and the reflection wave $R_2$ cancel each other, thereby making it possible to suppress the secondary component $f_2$ of the exhaust gas sound caused by the air column resonance and thus drastically decrease the sound pressure level of the exhaust gas sound.

The length (mm) of the muffler 27 and the outer shape size (mm) of the muffler 27, the numbers of resonance chambers and the expanded chamber, the inner diameters (mm), the thicknesses (mm) and the lengths (mm) of the inlet pipe portion 26A and the tail pipe 28, the thickness (mm) of the plate 41, the diameter $D_1$ of the plate 41, the diameter $D_2$ of the through bore 41*c* of the open portion 41*d*, the total area $S_1$ of the side surface portion 41*b* of the open portion 41*d* of the plate 41, the opening area $S_2$, the distances L(mm), $L_1$(mm), $L_2$(mm), and $L_3$ (mm) of the exhaust apparatus 20 according to the first embodiment are properly selected based on the data including various designed dimensions of the vehicle, simulation, experiments and experiences to be applied for the exhaust apparatus 20 according to the present embodiment.

The exhaust apparatus 20 for the internal combustion engine according to the first embodiment is constructed as stated in the previous description, and thus has an effect as follows.

As previously mentioned, the exhaust apparatus 20 for the internal combustion engine according to the first embodiment is provided with a tail pipe 28 for discharging to the atmosphere the exhaust gas discharged from the engine 21. The tail pipe 28 has an upstream open end 28*a* connected with the muffler 27 at the upstream side of the exhaustion direction of the exhaust gas, and a downstream open end 28*b* for discharging the exhaust gas to the atmosphere at the downstream side of the muffler 27. The exhaust apparatus 20 for the internal combustion engine according to the first embodiment is further provided at the downstream side of the tail pipe 28 in the exhaust direction of the exhaust gas with a diameter expansion structure 38 expanded in diameter toward the downstream open end 28*b*, and a plate 41 held in opposing relationship with the exhaust direction of the exhaust gas. The plate 41 is characterized by being formed with an open portion 41*d* passing through the plate 41 in the exhaust gas direction. The opening area $S_2$ ($m^2$) of the open portion 41*d* is set at a size about ⅓ the total area $S_1$($m^2$) of the side surface portion 41*b* including the open portion 41*d*. The diameter expansion structure 38 is formed to have a conical portion 38*c*.

As a consequence, the diameter expansion structure 38 provided at the downstream side of the tail pipe 28 makes it possible to enlarge the opening area $S_2$ of the open portion 41*d* formed in the plate 41. In addition, the conical portion 38*c* formed in the diameter expansion structure 38 can bring about an advantage in that the exhaust gas sound incident to the inside of the tail pipe 28 can reliably reach the reflection surface portion 41*f* of the plate 41 without being reflected in the diameter expansion structure 38.

Since the open portion 41*d* is formed in the plate 41, the plate 41 can be formed with a closed portion 41*e* other than the open portion 41*d* at the downstream open end 28*b* of the plate 41.

The plate 41 formed with the closed portion 41*e* at the downstream open end 28*b* of the plate 41 makes it possible to distribute the reflection wave reflected from the downstream open end 28*b* of the tail pipe 28 as will be described hereinafter when the incident wave caused by the exhaust gas pulsation at the time of the operation of the engine 21 is incident to the inside of the tail pipe 28 and reaches the downstream open end 28*b*.

More specifically, the reflection wave reflected from the downstream open end 28*b* of the tail pipe 28 can be distributed to what is called the reflection wave of the open end reflection caused by the open portion 41*d* the same in phase as the incident wave, and what is called the reflection wave of the closed end reflection caused by the closed portion 41*e* 180 degrees different in phase from the incident wave.

For this reason, the reflection wave of the open end reflection and the reflection wave of the closed end reflection canceling and interfering with each other make it possible to suppress the sound pressure level caused by the air column resonance of the tail pipe from being increased, thereby bringing about the relatively high sound deadening effect.

Especially when the frequency of the incident wave is coincided with the inherent air column resonance frequency of the tail pipe 28, there causes remarkably an interference effect between the reflection wave of the open end reflection and the reflection wave of the closed end reflection, thereby bringing about the advantage in that the air column resonance can be suppressed from being generated in the tail pipe 28.

As previously mentioned, the plate 41 having the open portion 41*d* at the downstream open end 28*b* of the tail pipe 28 makes it possible to suppress the sound pressure caused by the air column resonance of the tail pipe 28. In particular, there is caused another advantage in that the muffled sound in the passenger room of the vehicle at around the low rotation number of the engine 21 can be prevented.

Further, the exhaust apparatus 20 for the internal combustion engine according to the first embodiment need neither large sized sound deadening device like the main muffler provided in the conventional apparatus nor sub-muffler provided in the tail pipe 28, so that there is a further advantage in that the simple construction of only the plate 41 provided in the tail pipe 28 makes it possible to prevent the weight of the exhaust apparatus from being increased, and to prevent the production cost of the exhaust apparatus from being increased, thereby reducing the installation space of the exhaust apparatus.

The opening area $S_2$($m^2$) of the open portion 41*d* is set at a size about ⅓ the total area $S_1$($m^2$) of the side surface portion 41*b* including the open portion 41*d*, viz., the opening ratio of the plate 41 at the downstream open end 28*b* of the tail pipe 28 is set at about 33%. In this case, when the incident wave caused by the exhaust gas pulsation at the time of the operation of the engine 21 is incident to the inside of the tail pipe 28 and reaches the downstream open end 28*b*, the reflection wave reflected from the downstream open end 28*b* of the tail pipe 28 can effectively be distributed as will be described hereinafter.

More specifically, the reflection wave reflected at the downstream open end 28*b* of the tail pipe 28 can be distributed into the reflection wave the same in phase as the incident wave and caused by the open end reflection reflected at the open portion 41*d* occupying about 33% of the total area of the side surface of the plate 41, and the reflection wave 180 degrees different in phase from the incident wave and caused by the closed end reflection reflected from the closed portion 41*e* occupying about 67% of the total area previously mentioned.

For this reason, the reflection wave of the open end reflection and the reflection wave of the closed end reflection canceling and interfering with each other make it possible to reliably suppress the sound pressure level caused by the air column resonance of the tail pipe from being increased, thereby bringing about the relatively high sound deadening effect.

When the frequency of the incident wave is coincided with the inherent air column resonance frequency of the tail pipe 28, there causes remarkably an interference effect between the reflection wave of the open end reflection and the reflection wave of the closed end reflection, thereby bringing about the advantage in that the air column resonance can be suppressed even further from being generated in the tail pipe 28.

In the exhaust apparatus 20 according to the first embodiment, the pipe length L of the tail pipe 28 forms a half wavelength serving as a fundamental wavelength. Even in the case that the air column resonance is generated with the wavelength having a length obtained by dividing the fundamental wavelength with a natural number, it is possible to suppress the sound pressure from being increased by the air column resonance of the tail pipe 28, thereby making it possible to obtain such an advantageous effect that the muffled sound can be prevented from being generated in the passenger room while the engine 21 is operated at a low engine rotation number (2,000 rpm).

Further, the pipe length L of the tail pipe 28 forms a ¼ wavelength serving as a fundamental wavelength. Even in the case that the air column resonance is generated with the wavelength having a length obtained by dividing the fundamental wavelength with an uneven number, it is possible to suppress the sound pressure from being increased by the air column resonance of the tail pipe 28, thereby making it possible to obtain such an advantageous effect that the muffled sound can be prevented from being generated in the passenger room while the engine 21 is operated at a low engine rotation number (1,000 rpm).

More specifically, in the exhaust apparatus 20 according to the first embodiment, the opening ratio of the plate 41 at the downstream open end 28*b* of the tail pipe 28 is set at about 33%, so that there are occasionally generated two different reflection modes including a reflection mode of the complete open end having a standing wave of the air column resonance with a wavelength having a length obtained by dividing the fundamental wavelength with a natural number when the pipe length L of the tail pipe 28 forms a half wavelength serving as a fundamental wavelength, and a reflection mode of the complete closed end having a standing wave of the air column resonance with a wavelength having a length obtained by dividing the fundamental wavelength with an uneven number when the pipe length L of the tail pipe 28 forms a ¼ wavelength serving as a fundamental wavelength.

However, even in the case that any one of the reflection modes is generated, the reflection wave $R_1$ and the reflection wave $R_2$ can cancel and interfere with each other as shown in FIG. 10, thereby obtaining such an advantage that the sound level of the exhaust gas sound caused by the air column resonance can be drastically decreased, and thereby bringing about the relatively high sound deadening effect. The air resonance of the tail pipe 28 especially in the low rotation area of the engine 21 can reliably be suppressed from being generated irrespective of: the reflection modes.

The above exhaust apparatus 20 according to the first embodiment has been explained about the case in which the diameter expansion structure 38 and the plate 41 are provided only at the downstream open end 28*b* of the tail pipe 28. However, the exhaust apparatus 20 for the internal combustion engine can adopt any construction other than the above construction having the diameter expansion structure 38 and the plate 41 provided only at the downstream open end 28*b* of the tail pipe 28.

Figure 12:
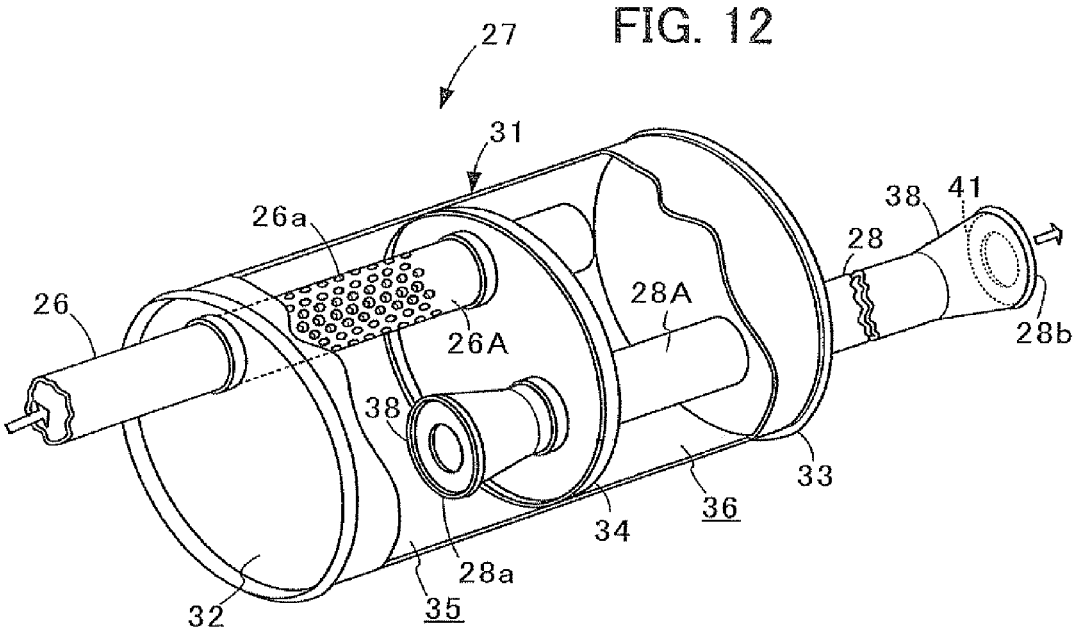
FIG. 12 shows the first embodiment of the exhaust apparatus for the internal combustion engine according to the present invention, and is a perspective view of a muffler connected to another tail pipe partly different in construction from the tail pipe shown in FIG. 2 and showing part of the muffler fragmentarily cross-sectioned.
Figure 13:
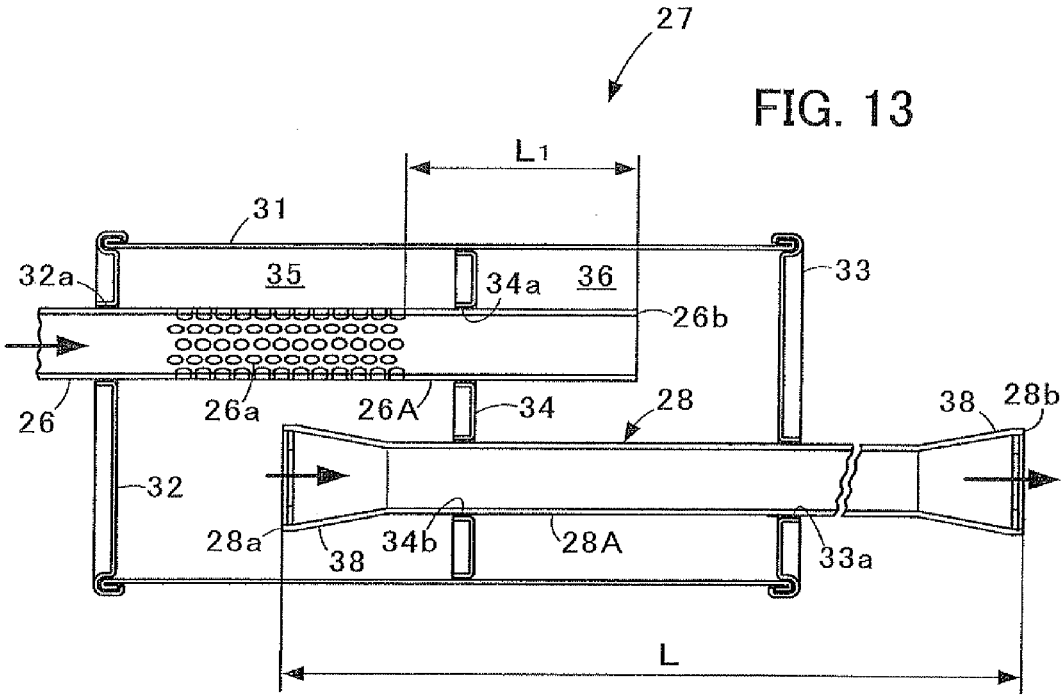
FIG. 13 shows the first embodiment of the exhaust apparatus for the internal combustion engine according to the present invention, and is a cross-sectional view taken on the plane passing through the center axes of the tail pipe and the center pipe, the tail pipe being partly different in construction from the tail pipe shown in FIG. 12.

For example, the exhaust apparatus 20 according to the first embodiment may be constructed to have the diameter expansion structure 38 and the plates 41 provided at both the upstream open end 28*a* and the downstream open end 28*b* of the tail pipe 28 as shown in FIGS. 12 and 13. The exhaust apparatus 20 may be constructed to have the diameter expansion structure 38 and the plate 41 provided only at the upstream open end 28*a* of the tail pipe 28. The above constructions in which the diameter expansion structure 38 and the plates 41 are provided at both the upstream open end 28*a* and the downstream open end 28*b* of the tail pipe 28, and in which the diameter expansion structure 38 and the plate 41 are provided only at the upstream open end 28*a* of the tail pipe 28 can obtain the same effect and advantage as previously mentioned.

Second Embodiment

As shown in FIGS. 14 to 20, the exhaust apparatus 60 according to the second embodiment is constructed similarly to the exhaust apparatus 20 according to the first embodiment. Further, the exhaust apparatus 60 according to the second embodiment is different in construction from the exhaust apparatus 20 according to the first embodiment in the aspect of the tail pipe 28 of the muffler 27, but other constitution elements of the exhaust apparatus 60 according to the second embodiment are the same in construction as those of the exhaust apparatus 20 according to the first embodiment. Therefore, description will be made hereinafter with the same constitution elements bearing the same reference numerals as those of the first embodiment shown in FIGS. 1 to 13. The following detailed description will be focused particularly only on the different points.

First, the construction of the second embodiment will be explained hereinafter.

Figure 14:
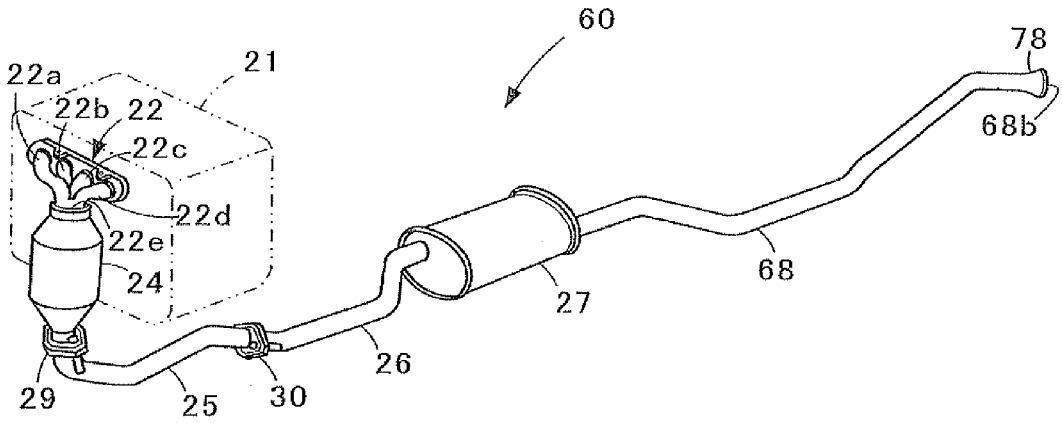
FIG. 14 shows a second embodiment of the exhaust apparatus for the internal combustion engine according to the present invention, and shows a perspective view of the construction of another exhaust gas system for the internal combustion engine.

The exhaust apparatus 60 according to the second embodiment is, as shown in FIG. 14, applied to the engine 21 similarly to the first embodiment, and has a tail pipe 68 forming part of the exhaust apparatus 60, the tail pipe 68 being different in construction from that of the first embodiment.

Figure 15:
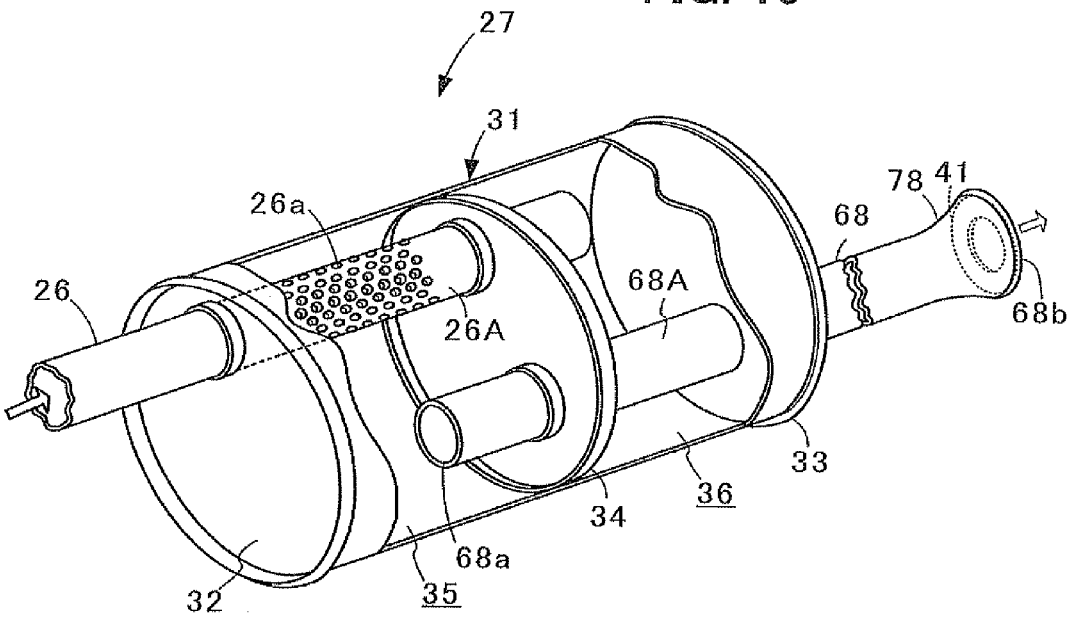
FIG. 15 shows the second embodiment of the exhaust apparatus for the internal combustion engine according to the present invention, and is a perspective view of a muffler connected with the tail pipe and partly shown in cross-section.
Figure 16:
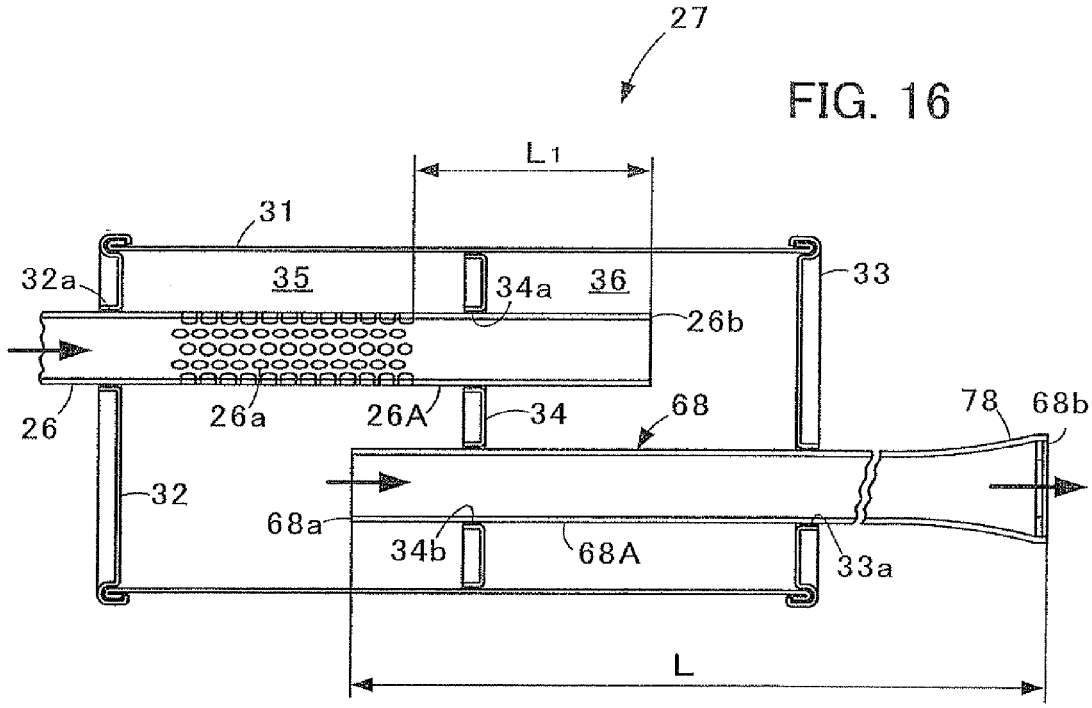
FIG. 16 shows the second embodiment of the exhaust apparatus for the internal combustion engine according to the present invention, and is a cross-sectional view of the muffler taken on the plane passing through the center axes of the tail pipe and the center pipe shown in FIG. 15.

As shown in FIGS. 15 to 16, the tail pipe 68 is constructed by a cylindrical pipe, and has an outlet pipe portion 68A having an upstream open end 68*a* at the upstream end portion thereof. The tail pipe 68 has a downstream end portion having a downstream open end 68*b* spaced apart by a distance L from the upstream open end 68*a* as shown in FIG. 16. The outlet pipe portion 68A extends through the through bores 34*b*, 33*a* to be connected with the muffler 27 with the upstream open end 68*a* being open in the expansion chamber 35.

Figure 17:
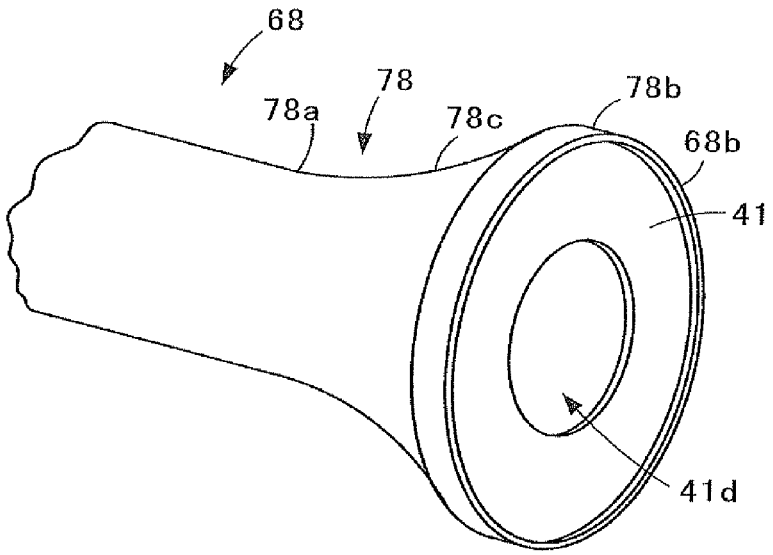
FIG. 17 shows the second embodiment of the exhaust apparatus for the internal combustion engine according to the present invention, and shows a perspective view of the tail pipe which is seen from the downstream open end of the tail pipe.
Figure 18:
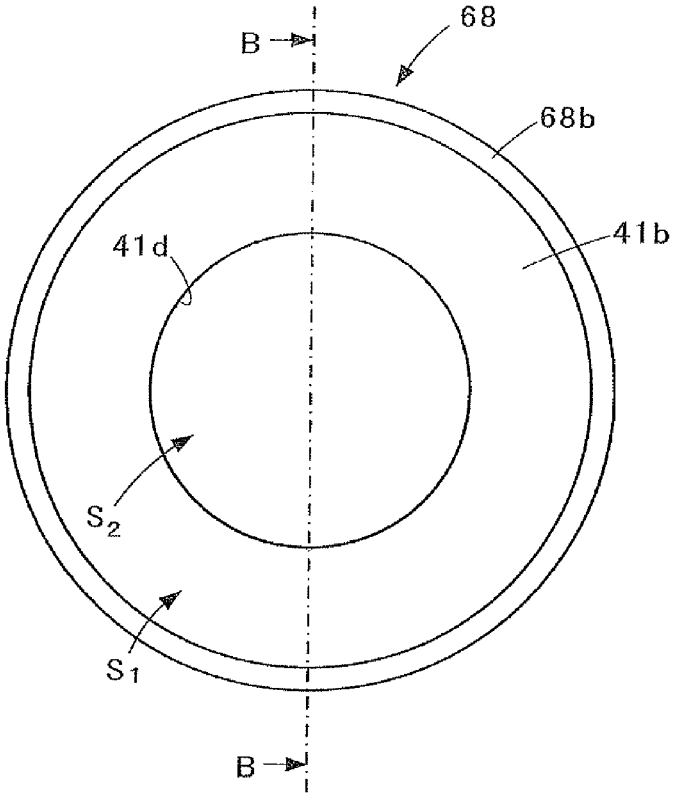
FIG. 18 shows the second embodiment of the exhaust apparatus for the internal combustion engine according to the present invention, and shows a front elevational view of the tail pipe which is seen from the downstream open end of the tail pipe.
Figure 19:
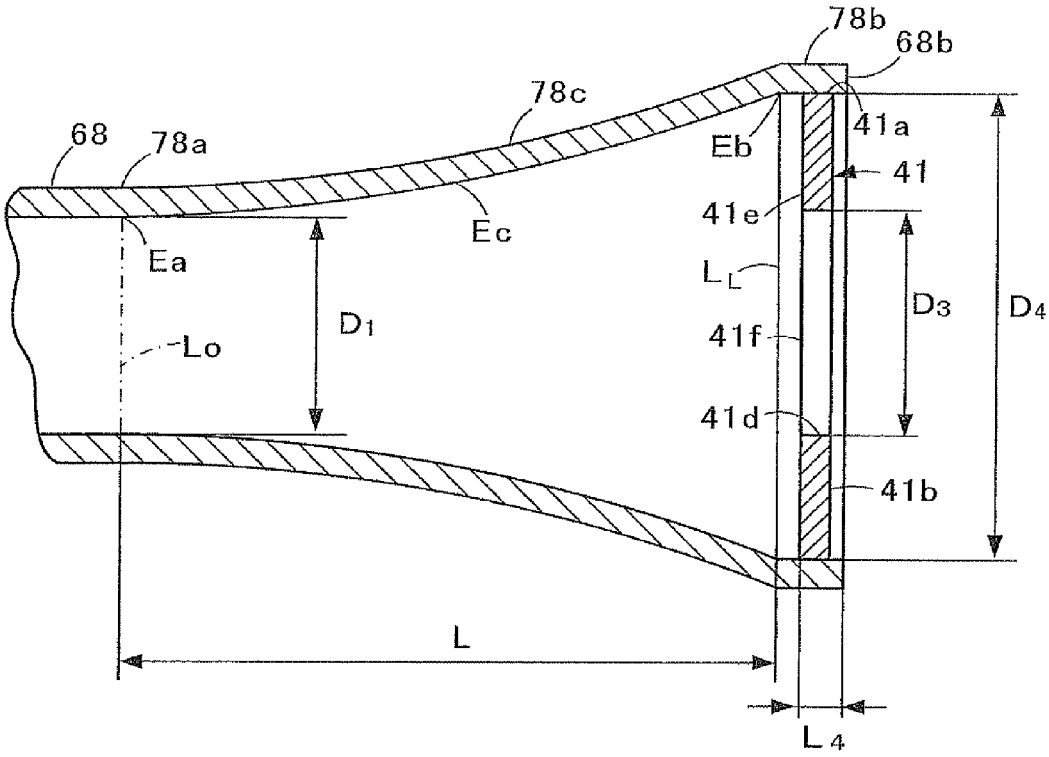
FIG. 19 shows the second embodiment of the exhaust apparatus for the internal combustion engine according to the present invention, and is a cross-sectional view taken along and seen from the line B-B of FIG. 18.

As shown in FIGS. 17, 18 and 19, the downstream open end 68*b* of the tail pipe 68 is provided with a diameter expansion structure 78 expanded in diameter radially outwardly toward the downstream open end 68*b*, and provided with a plate 41 held in opposing relationship with the exhaust direction of the exhaust gas.

Figure 20:
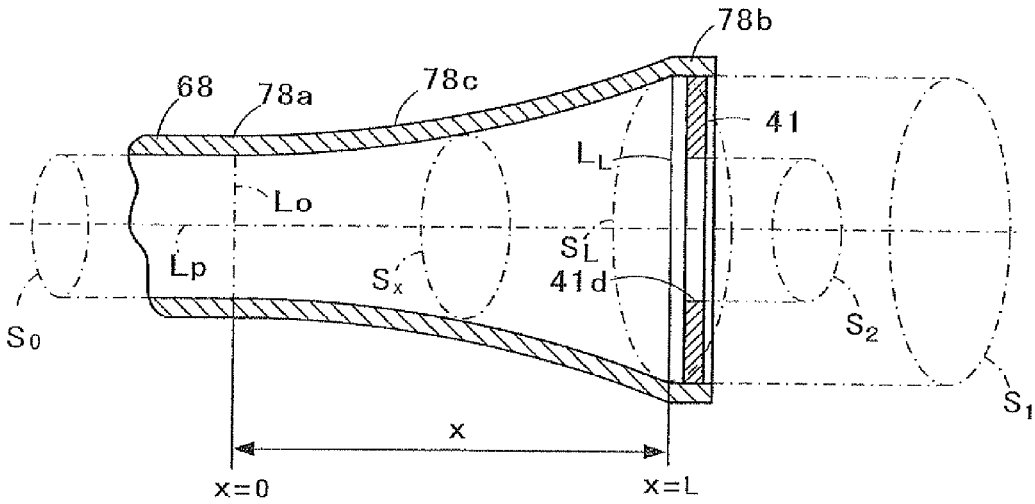
FIG. 20 shows the second embodiment of the exhaust apparatus for the internal combustion engine according to the present invention, and is an explanation view for explaining the exponential diameter expansion structure.

The diameter expansion structure 78 is shown in FIGS. 19 and 20 to comprise a base end portion 78*a* having an inner diameter $D_1$ the same as the inner diameter of the tail pipe 68, a forward end portion 78*b* having an inner diameter $D_4$ larger than the inner diameter $D_1$ of the base end portion 78*a*, an exponential shape portion 78*c* formed between the base end portion 78*a* and the forward end portion 78*b* to have a cross section expanded in diameter toward the forward end portion 78*b* from the base end portion 78*a* along an exponential curve.

The exponential shape portion 78*c* is formed along an exponential curve to have a curve Ec connecting a point Ea on the inner peripheral surface of the base end portion 78*a* with a point Eb on the inner peripheral surface of the forward end portion 78*b*. Here, the cross-sectional area passing the point Ea is represented by So, the standard line passing the point Ea and perpendicular to the tail pipe 68 is represented by Lo, and the position of the standard line Lo is represented by x=0.

The cross-sectional area of the exponential shape portion 78*c* passing the point Eb is represented by $S_L$, the standard line passing the point Eb and perpendicular to the tail pipe 68 is represented by $L_L$, and the position of the standard line $L_L$ is represented by x=L. The given distance from the position x=0 between the position x=0 and the position x=L is represented by x, a constant value is represented by "ε", and an incremental ratio of the cross-sectional area Sx of the exponential shape portion 78*c* is represented by "m". In this case, the following equation (14) is given based on "m", a natural number. The cross-sectional area Sx at the position "x" is represented by a following exponential function (15) based on the exponential curve. Here, "Ln" represents a natural logarithm basing a constant number "e" (2.71828182845904).

$$m = \left(\frac{1}{L}\right)\mathrm{Ln}\left(\frac{S_1}{S_0}\right) \tag{14}$$

$$S_X = S_0 \varepsilon^{mx} \tag{15}$$

In this case, the centers of the expanded cross-sections are in coaxial relationship with the center axis Lp of the tail pipe 68. More specifically, as shown in FIG. 20, the cross-section of the cross-sectional area So, the cross-section of the cross-sectional area Sx, the cross-section of the cross-sectional area $S_L$ have respective centers which are in coaxial relationship with the center axis Lp of the tail pipe 68.

The diameter expansion structure 78 is provided with the exponential shape portion 78*c* to ensure that reflection is reliably suppressed so as not to be generated in the diameter expansion structure 78 when an incident wave formed by the exhaust gas sound incident to the inside of the tail pipe 68 reaches to the plate 41.

It is generally known that the sound wave passing through a pipe having a constant cross-sectional area advances in a plane wave, while if the cross-sectional area of the pipe is changed, there is caused a reflection of the sound wave in response to the changed cross-sectional area of the pipe.

However, even in the case that the cross-sectional area of the pipe is changed, the changed cross-sectional area formed by the exponential shape represented by the following equation (15) based on the exponential curve leads to the cross-section Sx changed based on the exponential curve at the position "x" in the range 0≦x≦L.

In this case, the exponential shape portion 78 allows a roughly ideal plane wave propagation to be realized in the exponential shape portion 78, so that the incident wave passing through the exponential shape 78*c* is by no means reflected. This means that the incident wave into the tail pipe 68 is not reflected and thus reaches the reflection surface portion 41*f* of the plate 41 in a plane wave condition when the incident wave passes through the exponential shape portion 78*c*.

Here, the cross-sectional area $S_o$, the cross-sectional area $S_L$, and the distance L are properly selected based on the data including various designed dimensions of the vehicle, simulation, experiments and experiences to be applied for the exhaust apparatus 60 according to the present embodiment.

The exponential shape portion 78*c* may be formed not only by the previously mentioned exponential function, but also by a hyperbolic shape portion having what is called a hyperbolic shape represented by the following equation (16).

$$S_x = S_o(\cos h \cdot mx + T \sin h \cdot mx) \tag{16}$$

Here, "cos h" represents a hyperbolic cosine, "sin h" represents a hyperbolic sine, "m" represents a function represented by the afore mentioned equation (14), "Sx" represents a cross-sectional area of the exponential shape portion at the "x" position based on the hyperbolic shape, and "T" represents "0" to "∞".

In this case, the hyperbolic shape portion being formed into a shape represented by the equation (16) leads to the cross-sectional area "Sx" being changed based on the function of the position "x" in the range of 0≦x≦L. In this case, the hyperbolic shape portion allows a roughly ideal plane wave propagation to be realized therein, so that the incident wave passing through the hyperbolic shape portion is by no means reflected. This means that the incident wave incident to the inside of the tail pipe 68 is not reflected and reaches the reflection surface portion 41*f* of the plate 41 in a plane wave when the incident wave passes through the hyperbolic shape portion.

Next, the operation of the exhaust apparatus 60 and the reason of generating the air column resonance will be explained hereinafter.

When the engine 21 upstream of the exhaust apparatus 60 is started, the exhaust gas emitted from each of the cylinders of the engine 21 is discharged to the atmosphere through the open portion 41*d* of the plate 41 provided at the forward end portion 78*b* of the diameter expansion structure 78 in the same manner as that of the first embodiment.

The diameter expansion structure 78 is formed to have an inner diameter $D_4$ larger than the inner diameter $D_1$ of the tail pipe 28, while the open portion 41*d* of the plate 41 is formed to have an inner diameter $D_3$ equal to the inner diameter $D_1$ of the tail pipe 68. This results in the fact that the plate 41 provided at the downstream open end 68*b* can, similarly to the first embodiment, allow the exhaust gas to smoothly pass through the open portion 41*d* while the exhaust gas is passing through the open portion 41*d*, thereby making it possible to suppress the back pressure of the exhaust gas from being increased.

In the similar operation to the first embodiment, the exhaust gas pulsation excited by each of the cylinders of the engine 21 exploded during the operation of the engine 21 causes the exhaust gas sound having frequencies (Hz) varied in response to the rotation number (rpm) of the engine 21 to be generated from each of the cylinders of the engine 21. The exhaust gas sound is incident to the inside of the inlet pipe portion 26A. The exhaust gas sound incident to the inside of the inlet pipe portion 26A is incident to the expansion chamber 35 through the small through bores 26*a* of the inlet pipe portion 26A. The exhaust gas sound incident to the inside of the inlet pipe portion 26A is then incident to the resonance chamber 36 through the downstream open end 26*b*. In the exhaust gas sound incident to the resonance chamber 36, the sound pressure level of the exhaust gas sound having a specific frequency set by the Helmholtz resonance can be decreased.

The exhaust gas sound incident to the expansion chamber 35 is incident to the inside of the tail pipe 68 to become an incident wave which is in turn reflected by the plate 41 at the downstream open end 68*b* of the tail pipe 68 to become a reflection wave. Here, the diameter expansion structure 78 formed to be expanded in diameter toward the downstream end 68*b* causes the total area $S_1$ of the side surface portion 41*b* including the open portion 41*d* of the plate 41 to become larger than the cross-sectional area of the tail pipe 68. The diameter expansion structure 78 having the exponential shape portion 78*c* can allow the exhaust gas sound to propagate in a roughly complete plane wave in the diameter expansion structure 78, thereby making it possible to prevent the exhaust gas sound from not reaching the reflection surface portion 41*f* of the plate 41.

It is therefore to be noted that the exhaust gas sound incident to the inside of the tail pipe 68 can reliably reach the reflection surface portion 41*f* of the plate 41 without being subjected to the loss caused by the reflection of the exhaust gas sound while passing through the diameter expansion structure 78.

The reflection wave generated by the open end reflection and the reflection wave generated by the closed end reflection cause an interference therebetween to cancel each other. The reflection wave generated by the open end reflection and the reflection wave generated by the closed end reflection further reflect each other at the upstream open end 68*a* of the tail pipe 68 to advance toward the downstream open end 68*b* similarly to the incident wave previously mentioned and to reflect again similarly to the incident wave reflected before at the plate 41. It is thus to be noted that the reflections thus caused are repeated.

The following effect can be obtained since the exhaust apparatus 60 for the internal combustion engine according to the second embodiment is constructed as stated in the previous description.

As previously mentioned, the exhaust apparatus 60 for the internal combustion engine according to the second embodiment is provided with a tail pipe 68 for discharging to the atmosphere the exhaust gas discharged from the engine 21. The tail pipe 28 has an upstream open end 68*a* connected with the muffler 67 at the upstream side of the exhaustion direction of the exhaust gas, and a downstream open end 68*b* for discharging the exhaust gas to the atmosphere at the downstream side of the muffler 27.

The exhaust apparatus 60 for the internal combustion engine according to the second embodiment is further provided at the downstream open end 68*b* with a diameter expansion structure 78 expanded in diameter radially outwardly toward the downstream open end 68*b*, and a plate 41 provided in opposing relationship with the exhaust direction of the exhaust gas. The plate 41 is characterized by having a side surface portion 41*b* held in opposing relationship with the exhaust direction of the exhaust gas and formed with an open portion 41*d*. The opening area $S_2$ of the open portion 41*d* is set at a size about ⅓ the total area $S_1$ of the side surface portion 41*b* including the open portion 41*d*. The diameter expansion structure 78 is formed with an exponential shape portion 78*c*.

As a consequence, the opening area $S_2$ of the open portion 41*d* formed in the plate 41 can be enlarged since the diameter expansion structure 78 is provided at the downstream open end 68*b* of the tail pipe 28. In addition, the exponential shape portion 78*c* formed in the diameter expansion structure 78 can bring about an advantage in that the exhaust gas sound incident to the inside of the tail pipe 28 can reliably reach the reflection surface portion 41*f* of the plate 41 in a roughly completely plane wave without being reflected in the diameter expansion structure 78. Since the open portion 41*d* is formed in the plate 41, the plate 41 can be formed with a closed portion 41*e* other than the open portion 41*d* at the downstream open end 28*b* of the plate 41. Therefore, the reflection wave generated by the open end reflection and the reflection wave generated by the closed end reflection cancel each other, thereby making it possible to suppress the air column resonance caused by the reflection wave of the exhaust gas sound.

The previously mentioned description has been concerned with the case in which the diameter expansion structure 78 and the plate 41 are provided only at the downstream open end 68*b* of the tail pipe 28. However, the exhaust apparatus for the internal combustion engine according to the present invention may have a construction other than the construction provided with the diameter expansion structure 78 and the plate 41.

For example, the exhaust apparatus for the internal combustion engine according to the present invention may be constructed to have the diameter expansion structures 78 and the plates 41 provided at both of the upstream open end 68*a* and the downstream open end 68*b*, respectively. Further, the exhaust apparatus for the internal combustion engine according to the present invention may be constructed to have the diameter expansion structure 78 and the plate 41 provided only at the upstream open end 68*a* of the tail pipe 28. The constructions in these cases that the diameter expansion structures 78 and the plates 41 are provided at both of the upstream open end 68*a* and the downstream open end 68*b*, respectively, and that the diameter expansion structure 78 and the plate 41 provided only at the upstream open end 68*a* can obtain an advantageous effect the same as that of the previously mentioned construction.

Third Embodiment

Figure 21:
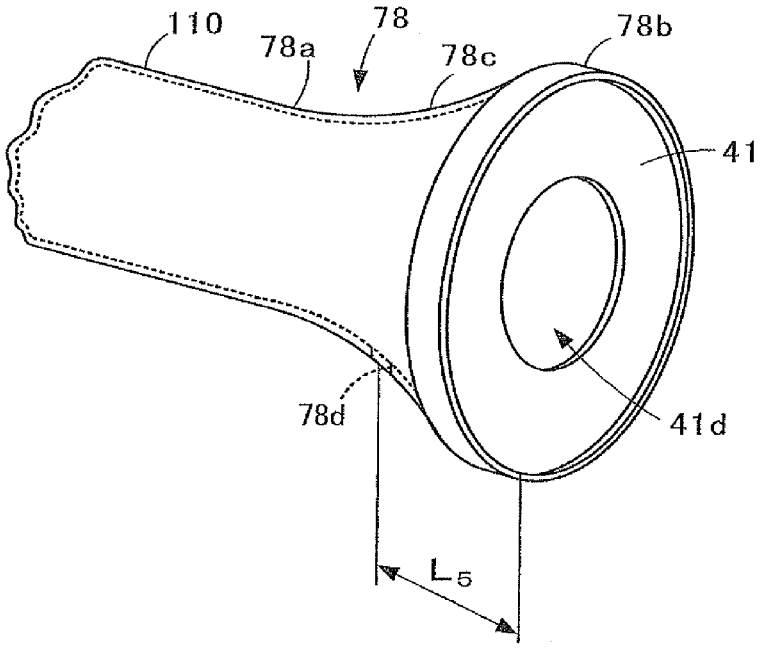
FIG. 21 shows a third embodiment of the exhaust apparatus for the internal combustion engine according to the present invention, and shows a perspective view of the tail pipe which is seen from the downstream open end of the tail pipe.
Figure 22:
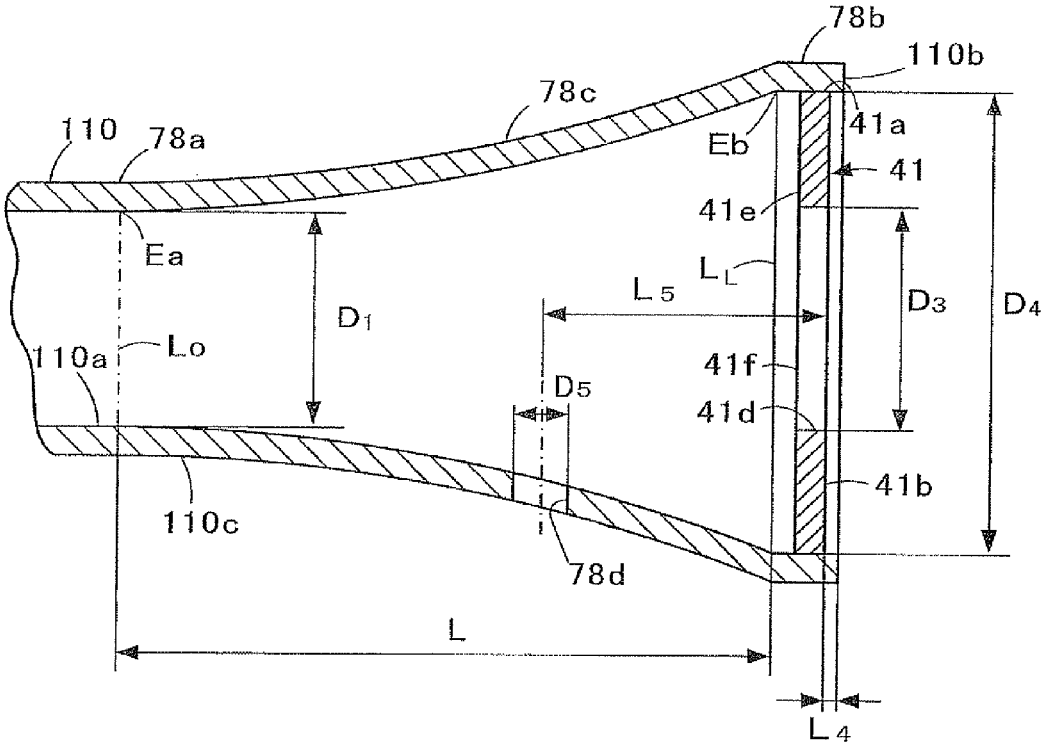
FIG. 22 shows the third embodiment of the exhaust apparatus for the internal combustion engine according to the present invention, and is a cross-sectional view of the tail pipe showing the cross-section of FIG. 21.
Figure 23:
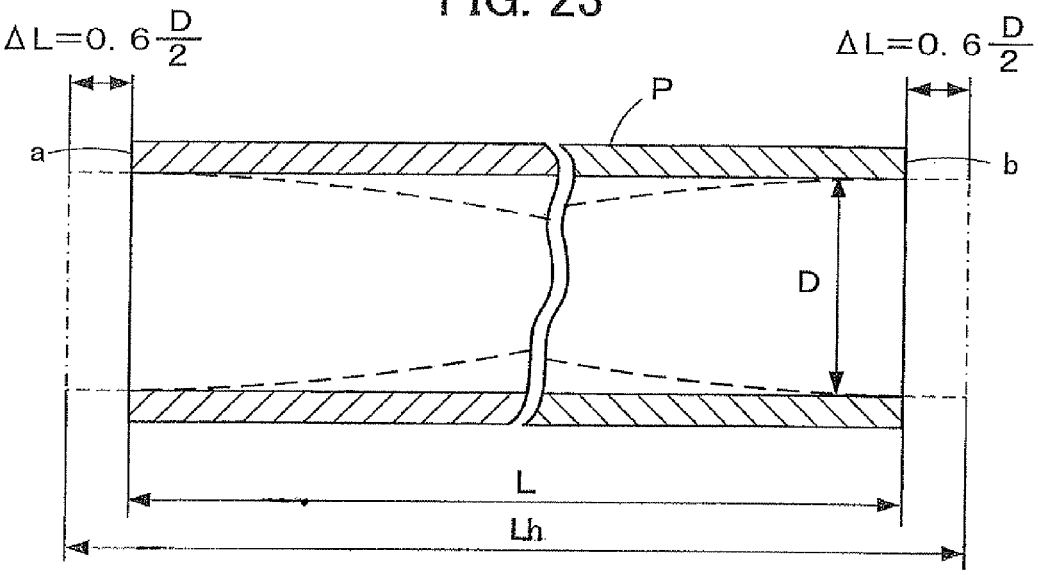
FIG. 23 shows the third embodiment of the exhaust apparatus for the internal combustion engine according to the present invention, and is a perspective view for explaining the open end correction of the tail pipe.

FIGS. 21 to 23 show a tail pipe 110 according to the third embodiment. The tail pipe 110 according to the third embodiment is, as shown in FIG. 21, newly provided with a through bore 78*d* which is added to the tail pipe 68 of the exhaust apparatus 60 according to the second embodiment. The through bore 78*d* is provided for the purpose of correcting the reflection position of the incident wave in the open end reflection at the open portion 41*d* of the plate 41. The following description will be directed to the correction of the reflection position at the open portion 41*d* of the plate 41.

(Open End Correction)

It is generally known that the length of the air column in the air column resonance generated in the pipe is longer than the length of the air column of a real pipe formed by the both ends of the pipe. This is because the real reflection position of the sound wave takes a position spaced apart by a predetermined distance from the pipe in the case of the open end reflection.

For example as schematically shown in FIG. 23, the real length of the air column in the air column resonance generated in the tail pipe P becomes the length Lh of the air column somewhat longer than the pipe length L from the upstream end "a" of the tail pipe P to the downstream end "b" of the tail pipe P. In order to more accurately assess such a real length of the air column, it is generally required to perform the correction of length called a length correction.

More concretely, the distance to the real reflection position of the exhaust gas sound outwardly spaced apart from the upstream open end "a" and the distance to the real reflection position of the exhaust gas sound outwardly spaced apart from the downstream open end "b" are each represented by ΔL, while the inner diameter of the tail pipe P is represented by "D". The distance ΔL is given by the following equation (17).

$$\Delta L = 0.6\frac{D}{2} \tag{17}$$

Therefore, the length Lh of the air column in consideration of the open end correction is obtained by Lh=L+2ΔL.

The following reason will be raised for requiring the open end correction as previously mentioned.

The advance wave propagating in the tail pipe P actually reflects at a position spaced apart by the distance ΔL downstream of the downstream open end "b", while the reflection wave actually reflects at a position spaced apart by the distance ΔL upstream of the upstream open end "a". At the outsides of the downstream open end "b" and the upstream open end "a" of the tail pipe P having both ends open, there exists an exhaust gas the same as that in the tail pipe P and having a temperature (centigrade) the same as that in the tail pipe P. The energy (J) of the sound is, strictly speaking, transmitted to the outsides of the neighborhoods of the downstream open end "b" and the upstream open end "a" of the tail pipe P through which the exhaust gas is discharged.

For this reason, the sound pressures (Pa) at the downstream open end "b" and the upstream open end "a" does not become zero, while the sound pressures (Pa) at positions spaced apart by the distances ΔL outwardly of the downstream open end "b" and the upstream open end "a" become zero. This means that the positions spaced apart by the distances ΔL outwardly of the downstream open end "b" and the upstream open end "a" serve as effective pipe ends, respectively. As a result, the incident wave comes to be reflected at the effective pipe ends spaced apart by the distances ΔL outwardly of the downstream open end "b" and the upstream open end "a". Further, the reflection wave reflected at the downstream open end "b" comes to be reflected at the effective pipe end spaced apart by the distance ΔL outwardly of the upstream open end "a".

As will be understood from the foregoing description, it is preferable to correct only with the distance ΔL from the downstream open end "b" to make the corrected downstream open end "b" the effective pipe end in order to obtain a relatively high sound deadening effect.

The tail pipe 110 according to the third embodiment is formed with the through bore 78*d* which serves to correct the effective pipe end to have the effective open end be close to the downstream open end 110*b* of the tail pipe 110, thereby obtaining the high sound deadening effect.

More specifically, as shown in FIGS. 21 and 22, the exponential shape portion 78*c* of the tail pipe 110 is formed at a position spaced apart by the distance $L_5$ axially inwardly of the tail pipe 110 from the side surface portion 41*b* of the plate 41 with a through bore 78*d* having a diameter $D_5$ and allowing the inner peripheral portion 110*a* and the outer peripheral portion 110 of the tail pipe 110 to be held in communication with each other. In other words, the through bore 78*d* is positioned at the upstream side of the plate 41, viz., at the upstream side of the downstream open end 110*b* in the exhaust direction of the exhaust gas in the tail pipe 110.

Figure 24:
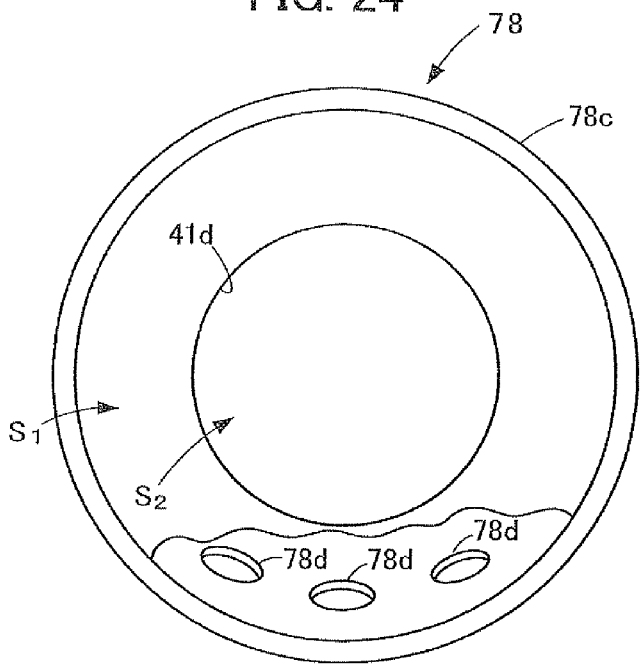
FIG. 24 shows the third embodiment of the exhaust apparatus for the internal combustion engine according to the present invention, and is a front elevational view of the tail pipe which is seen from the downstream open end of the tail pipe.

The through bore 78*d* may be replaced by a plurality of through bores according to the present invention. For example, the exponential shape portion 78*c* of the tail pipe 110 may be formed as shown in FIG. 24 with three through bores spaced apart by the distance $L_5$ axially inwardly from the side surface portion 41*b* of the plate 41, viz., at the upstream side of the downstream open end 110*b* in the exhaust direction of the exhaust gas in the tail pipe 110.

The above construction of one or more through bores 78*d* leads to constituting part of the open portion 41*d* of the plate 41, so that the effective pipe end of the air column resonance spaced apart by the distance ΔL from the downstream open end 110*b* comes closer to the open portion 41*d* of the plate 41. The distance ΔL is therefore illimitably close to zero, thereby enabling the effective reflection to be carried out at the open portion 41*d* of the plate 41.

Here, the diameter $D_5$ and the distance $L_5$ are properly selected based on the data including various designed dimensions of the vehicle, simulation, experiments and experiences to be applied for the tail pipe 110 according to the third embodiment. Further, the distance $L_5$ is preferably nearly equal to the distance ΔL represented by the equation (17) in the previously mentioned open end correction. The distance $L_5$ is set to enable the through bore 78*d* to form part of the open portion 41*d* of the plate and to obtain such an effect to carry out the effective open end reflection at the open portion 41*d* of the plate 41.

Therefore, the tail pipe 110 according to the third embodiment is simple in construction only with the provision of the through bore 78*d*, thereby making it possible to provide a roughly completely opposite phase to the open end reflection at the open portion 41*d* of the plate 41 and the closed end reflection at the closed portion 41*e* of the plate 41.

For this reason, the reflection wave of the open end reflection and the reflection wave of the closed end reflection canceling and interfering with each other make it possible to reliably suppress the sound pressure level caused by the air column resonance of the tail pipe from being increased.

Fourth Embodiment

Figure 25:
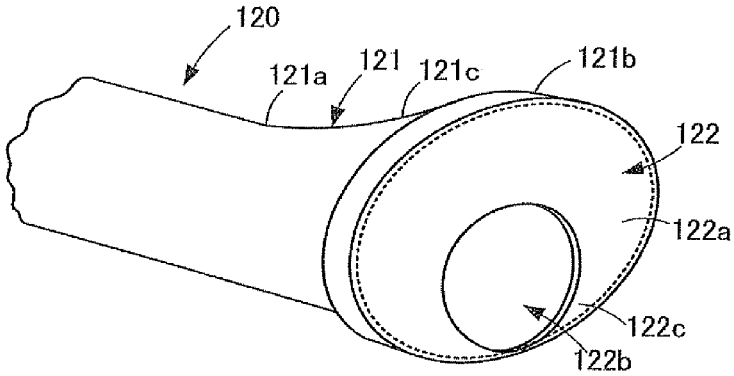
FIG. 25 shows a fourth embodiment of the exhaust apparatus for the internal combustion engine according to the present invention, and shows a perspective view of the tail pipe which is seen from the downstream open end of the tail pipe.
Figure 26:
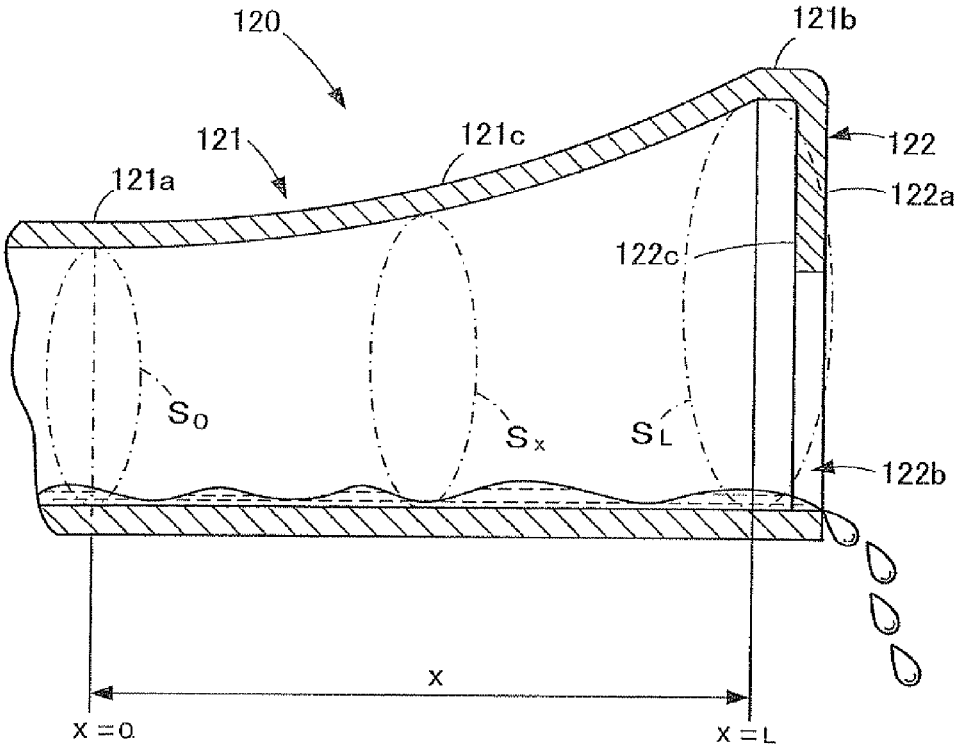
FIG. 26 shows the fourth embodiment of the exhaust apparatus for the internal combustion engine according to the present invention, and is a cross-sectional view of the tail pipe showing the cross-section of FIG. 25.

FIGS. 25 to 26 show a tail pipe 120 according to the fourth embodiment. As shown in FIG. 25, the tail pipe 68 according to the second embodiment has a circular cross-section, while the tail pipe 120 according to the fourth embodiment has an elliptical cross-section. The tail pipe 120 is formed with a diameter expansion structure 121 and a plate portion 122 which are integrally connected with each other at the downstream side of the tail pipe 120 in the exhaust gas direction.

The diameter expansion structure 121 is shown in FIG. 26 as being provided with a base end portion 121*a*, a forward end portion 121*b*, and an exponential shape portion 121*c*. The base end portion 121*a* has a cross-sectional area $S_o$ in a roughly elliptical shape the same as that of the tail pipe 120. The forward end portion 121*b* has a cross-section $S_L$ in a roughly elliptical shape. The exponential shape portion 121*c* is formed between the base end portion 121*a* and the forward end portion 121*b* and has a cross-sectional area $S_x$ in a roughly elliptical shape with the cross-sectional shape expanded in diameter along an exponential curve toward the forward end portion 121*b* from the base end portion 121*a*. The diameter expansion structure 121 is different from the diameter expansion structure 78 according to the second embodiment, and formed, as shown in FIG. 26, to have a cross-sectional area gradually radially outwardly expanded toward the forward end portion 121*b* and partly formed by a lower end extending on the straight flat surface toward the forward end portion 121*b*. This means that the lower ends of the cross-sectional areas $S_o$, $S_x$ and $S_L$ extend on the same straight line.

The exponential shape portion 121*c* is formed to have a cross-section axially changed in shape the same as that of the tail pipe 68 according to the second embodiment. This means that the exponential shape portion 121*c* is formed to meet the equations (14) and (15).

The plate portion 122 is integrally formed with the forward end portion 121*b* for example by a machine working such as a press drawing and the like, and a forming process such as a die cast and the like. The plate portion 122 has a side surface portion 122*a*, an open portion 122*b* formed to extend through the side surface portion 122*a*, and a closed portion 122*c* having a portion excluding the open portion 122*b*. The open portion 122*b* is, as shown in FIG. 26, formed to pass through the lower portion of the side surface portion 122*a* to allow an exhaust gas condensed water remaining in the tail pipe 120 to be discharged to the outside.

The plate portion 122 according to the fourth embodiment thus constructed can make the open end reflection at the open portion 122*b* and the closed end reflection at the closed portion 122*c* completely opposite in phase in a similar fashion to the plate 41 of the second embodiment, thereby obtaining an effect of having the open end reflection and the closed end reflection interfere with each other, and thus leading to a relatively high sound deadening effect. Further, the open portion 122*b* formed at the lower portion of the plate portion 122 makes it possible to discharge the exhaust gas condensed water remaining in the tail pipe 120 through the open portion 122*b* to the outside, thereby enhancing corrosion resistance and durability of the tail pipe 120 with the tail pipe 120 simple in construction.

Fifth Embodiment

Figure 27:
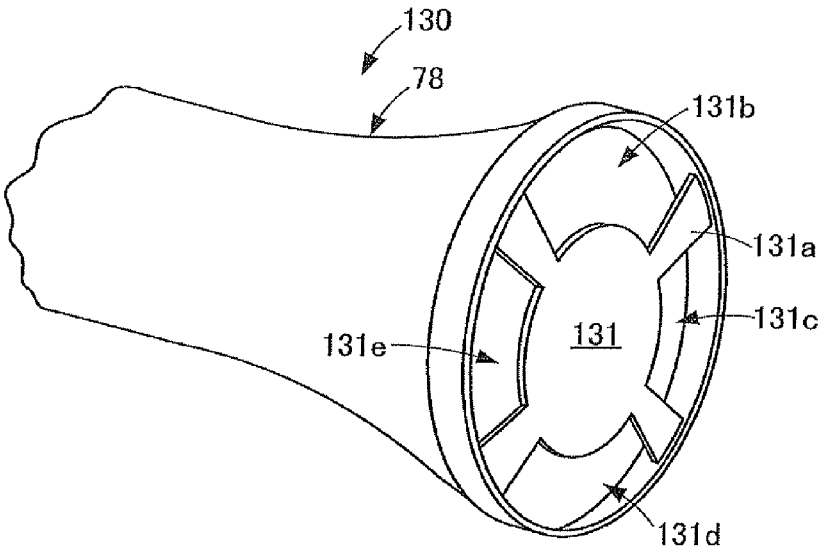
FIG. 27 shows a fifth embodiment of the exhaust apparatus for the internal combustion engine according to the present invention, and shows a perspective view of the tail pipe which is seen from the downstream open end of the tail pipe.
Figure 28:
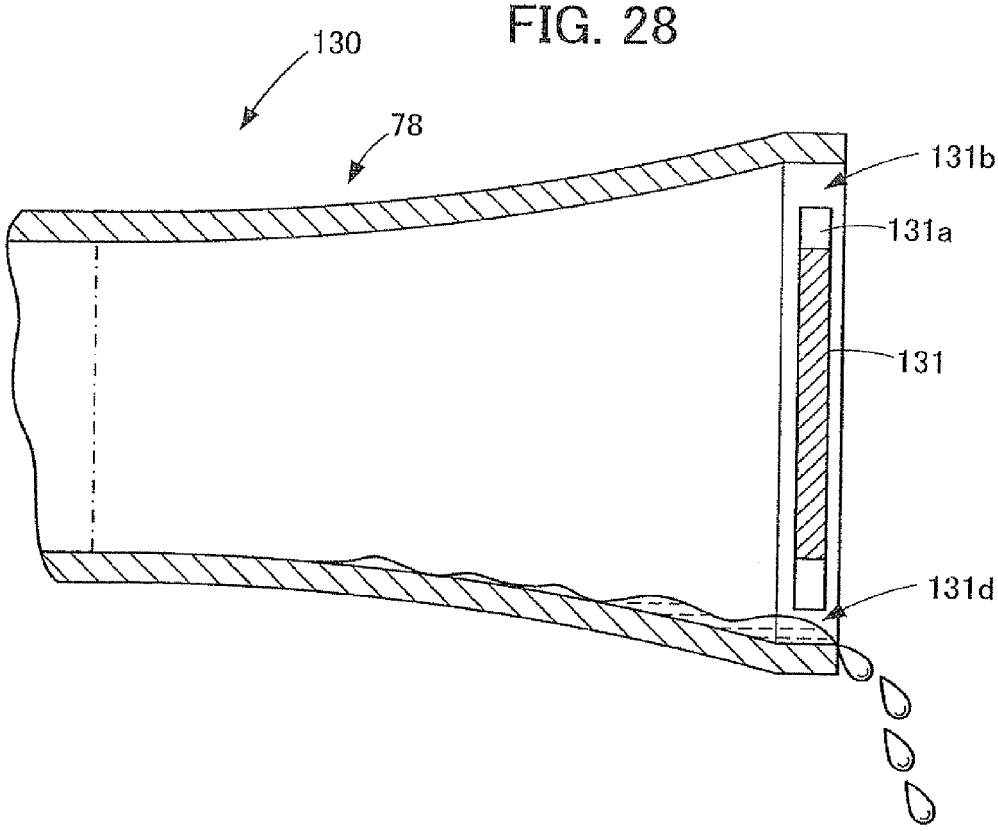
FIG. 28 shows the fifth embodiment of the exhaust apparatus for the internal combustion engine according to the present invention, and is a cross-sectional view of the tail pipe showing the cross-section of FIG. 27.

FIGS. 27 to 28 show a tail pipe 130 according to the fifth embodiment. As shown in FIG. 27, the tail pipe 68 according to the second embodiment has a diameter expansion structure 78 at the downstream side of the tail pipe 68 in the exhaust direction of the exhaust gas and a plate 41 having an central portion open, while the tail pipe 130 according to the fifth embodiment has a diameter expansion structure 78 at the downstream side of the tail pipe 130 in the exhaust direction of the exhaust gas, and a plate 131 having an central portion closed.

More specifically, the plate 41 of the second embodiment has an open portion 41*d* having a central portion circular in cross-section, while the plate 131 according to the fifth embodiment has a closed portion 131*a* having a peripheral portion formed with through bores respectively defining open portions 131*b*, 131*c*, 131*d*, 131*e* circumferentially equally spaced apart from one another.

The plate 131 according to the fifth embodiment thus constructed can make the open end reflection at the open portions 131*b*, 131*c*, 131*d*, 131*e* of the plate 131 and the closed end reflection at the closed portion 131*a* of the plate 131 completely opposite in phase in a similar fashion to the plate 41 of the second embodiment, thereby obtaining an effect of having the open end reflection and the closed end reflection interfere with each other, and thus leading to a relatively high sound deadening effect. Further, the open portion 131*d* formed in the plate 131 makes it possible to discharge the exhaust gas condensed water remaining in the tail pipe 130 through the open portion 131*d* to the outside, thereby enhancing corrosion resistance and durability of the tail pipe 130 with the tail pipe 130 simple in construction.

Sixth Embodiment

Figure 29:
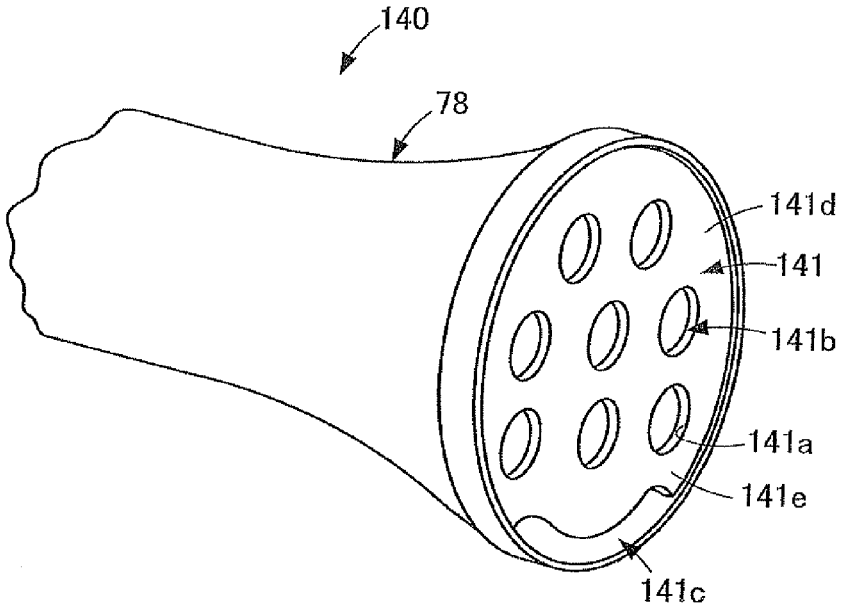
FIG. 29 shows a sixth embodiment of the exhaust apparatus for the internal combustion engine according to the present invention, and shows a perspective view of the tail pipe which is seen from the downstream open end of the tail pipe.

FIG. 29 shows a tail pipe 140 according to the sixth embodiment.

As shown in FIG. 29, the tail pipe 68 according to the second embodiment has a diameter expansion structure 78 at the downstream side of the tail pipe 68 in the exhaust direction of the exhaust gas and a plate 41 having an central portion formed with only an open portion 41*d*, while the tail pipe 140 according to the sixth embodiment has a diameter expansion structure 78 at the downstream side of the tail pipe 140 in the exhaust direction of the exhaust gas, and a plate 141 having an central portion formed with a plurality of through bores 141*a*.

More specifically, the plate 41 of the second embodiment has an open portion 41*d* having a central portion circular in cross-section, while the plate 141 according to the sixth embodiment has a central portion having an open portion 141*b* constituted by eight through bores 141*a*, and a lower portion formed with an open portion 141*c* constituted by a slit circumferentially extending. The plate 141 has a side surface portion 141*d* having a closed portion 141*e* excluding the open portions 141*b* and the open portion 141*c*.

The plate 141 according to the sixth embodiment thus constructed can make the open end reflection at the open portions 141*b*, 141*c*, of the plate 141 and the closed end reflection at the closed portion 141*e* of the plate 141 completely opposite in phase in a similar fashion to the plate 41 of the second embodiment, thereby obtaining an effect of having the open end reflection and the closed end reflection interfere with each other, and thus leading to a relatively high sound deadening effect. Further, the open portion 141*c* formed in the lower portion of the plate 141 makes it possible to discharge the exhaust gas condensed water remaining in the tail pipe 140 through the open portion 141*c* to the outside, thereby enhancing corrosion resistance and durability of the tail pipe 140 with the tail pipe 140 and the plate 141 simple in construction.

Seventh Embodiment

Figure 30:
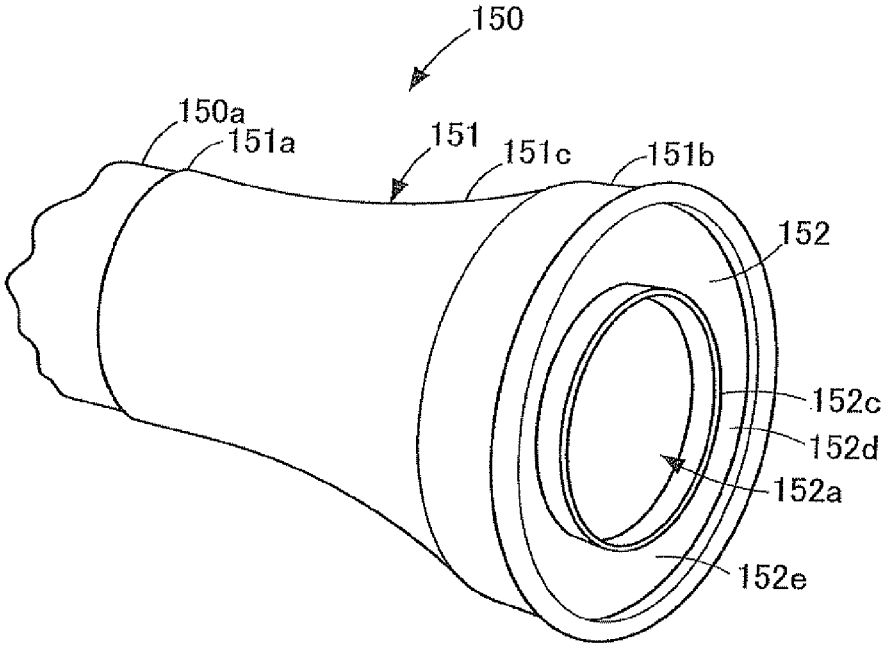
FIG. 30 shows a seventh embodiment of the exhaust apparatus for the internal combustion engine according to the present invention, and shows a perspective view of the tail pipe which is seen from the downstream open end of the tail pipe.
Figure 31:
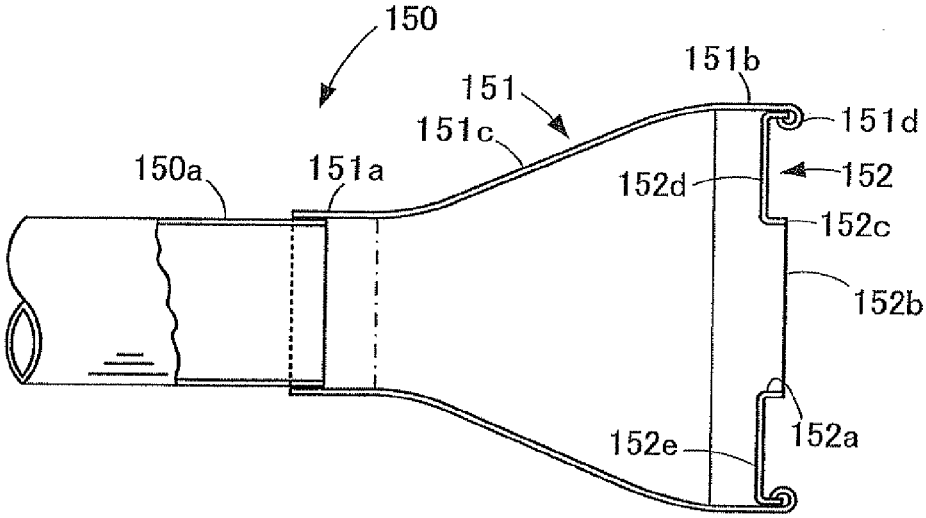
FIG. 31 shows the seventh embodiment of the exhaust apparatus for the internal combustion engine according to the present invention, and is a cross-sectional view of the tail pipe showing the cross-section of FIG. 30.
Figure 32:
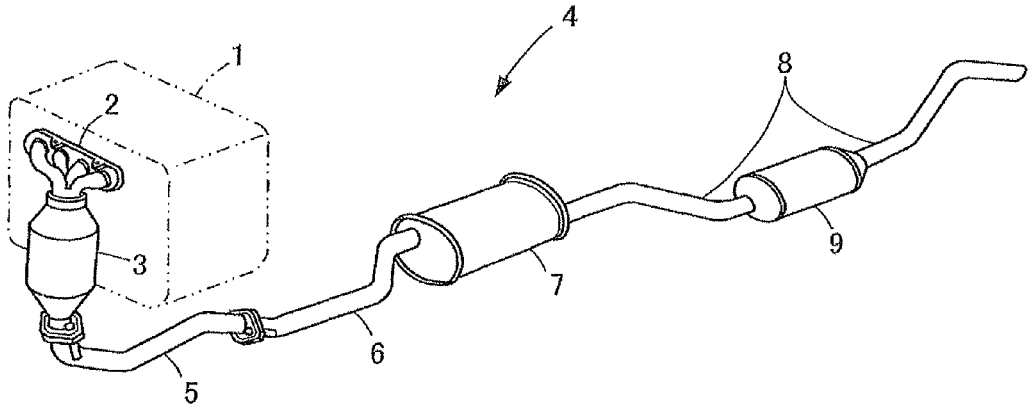
PRIOR ART FIG. 32
FIG. 32 is a perspective view showing the construction of an exhaust gas system provided with a conventional exhaust apparatus.
Figure 33:
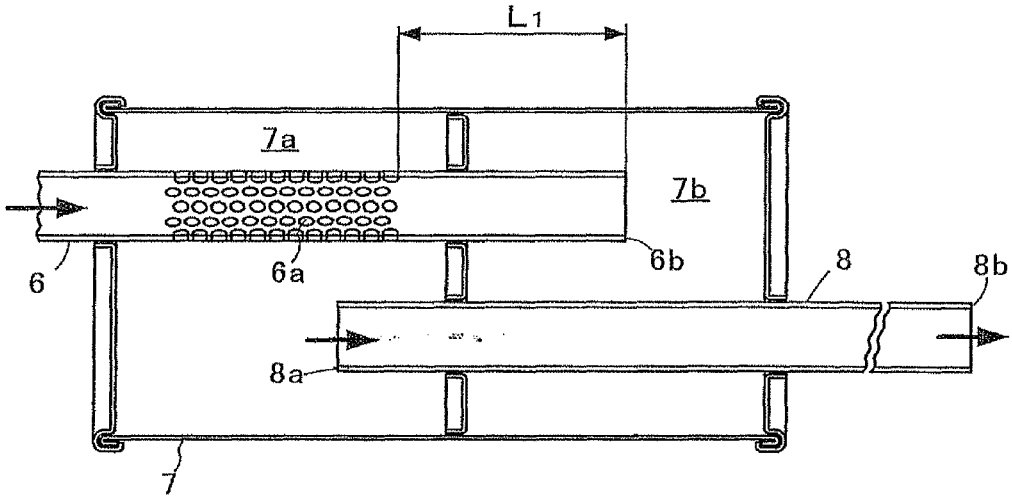
PRIOR ART FIG. 33
FIG. 33 shows the exhaust gas system provided with the conventional exhaust apparatus, and is a cross-sectional view of a muffler connected to a tail pipe having open ends at its both ends.

FIGS. 30 to 31 show a tail pipe 150 according to the seventh embodiment. As shown in FIG. 30, the tail pipe 150 according to the seventh embodiment has a diameter expansion structure 151 separable from the tail pipe 150, while the tail pipe 68 according to the second embodiment is integrally formed with the diameter expansion structure 78.

More specifically, the diameter expansion structure 151 is formed separately from the tail pipe 150 and assembled with the tail pipe 150 to surround the downstream open end 150*a* of the tail pipe 150 according to the seventh embodiment, while the tail pipe 68 according to the second embodiment is integrally formed with the diameter expansion structure 78.

The diameter expansion structure 151 is provided with a base end portion 151*a* connected with the tail pipe 150, a forward end portion 151*b* held in opposing relationship with the base end portion 151*a* and having an inner diameter larger than that of the base end portion 151*a*, and an exponential shape portion 151*c* positioned between the base end portion 151*a* and the forward end portion 151*b*. The exponential shape portion 151*c* is formed with constitution elements to meet the equations (14) and (15) similarly to the exponential shape portion 78*c* of the diameter expansion structure 78 according to the second embodiment.

The forward end portion 151*b* is, as shown in FIG. 31, worked to be turned back by a drawing process, and thus has a peripheral portion formed with a smooth edge portion 151*d* improved in excellent external appearance.

In contrast with the plate 41 of the tail pipe 68 according to the second embodiment having a shape in the disk-like form, the plate 152 according to the seventh embodiment has a peripheral end portion projecting in one axial direction of the tail pipe 150, the projecting end portion being assembled with the forward end portion 151*b* in such a way as to be contained in the turned-back portion of the forward end portion 151*b*.

The plate 152 is formed at its central portion with an open portion 152*b* constituted by a through bore 152*a*, and further formed with an annular projection portion 152*c* surrounding the through bore 152*a* and projecting in the direction the same as the projection portion formed in the plate 152. The plate 152 has a side surface portion 152*d* having a closed portion 152*e* excluding the open portion 152*b*.

The plate 152 forming part of the seventh embodiment thus constructed can make the open end reflection at the open portion 152*b* of the plate 152 and the closed end reflection at the closed portion 152*e* of the plate 152 completely opposite in phase in a similar fashion to the plate 41 of the second embodiment, thereby obtaining an effect of having the open end reflection and the closed end reflection interfere with each other, and thus leading to a relatively high sound deadening effect. Further, the tail pipe 150 having the diameter expansion structure 151 and the plate 152 can make it possible to serve as a diffuser which can introduce fluid to a predetermined position with a pressure loss as small as possible, and to remain in the same external appearance. The downstream open end 150*a* of the tail pipe 150 has an outer appearance with the diffuser attached thereto, thereby enhancing the excellent external appearance of the tail pipe 150.

As has been explained in the foregoing description, it will be understood that the exhaust apparatus for the internal combustion engine according to the present invention can realize no need to provide a sub-muffler in the tail pipe, and a sound deadening device having a resonance chamber with a large capacity at the upstream open end of the tail pipe, and can suppress the sound pressure level caused by the air column resonance from being increased, thereby making it possible to decrease the weight, the production cost and the installation space thereof. The apparatus according to the present invention is useful for whole exhaust apparatuses for the internal combustion engine.

| Explanation of Reference Numerals | |
|---|---|
| 20, 60: | exhaust apparatuses |
| 21: | engine |
| 22: | exhaust gas manifold |
| 24: | catalytic converter |
| 25: | front pipe |
| 26: | center pipe |
| 26A: | inlet pipe portion |
| 27: | muffler |

-continued

| Explanation of Reference Numerals | |
|---|---|
| 28, 68, 110, 120, 130, 140, 150: | tail pipes |
| 28A, 68A: | outlet pipe portions |
| 28a, 68a: | upstream open ends |
| 28b, 68b, 110b, 150a: | downstream open ends |
| 28c: | inner peripheral portion |
| 38, 78, 121, 151: | diameter expansion portions |
| 41, 131, 141, 152: | plates |
| 41b, 141d, 152d: | side surface portions |
| 41d, 131b, 131c, 131d, 131e, 141b, 141c, 152b: | open portions |
| 41e, 131a, 141e, 152e: | closed portions |
| 41f: | reflection surface portion |
| 78c,121c, 151c: | exponential shape portion |
| 78d: | through bore |
| $L_5$, $L_8$: | distances |
| $S_1$: | total area |
| $S_2$: | opening area |

The invention claimed is:

1. An exhaust apparatus for an internal combustion engine, comprising:

an exhaust gas pipe having one end portion formed with an upstream open end positioned at an upstream side of exhaust gas discharged from an internal combustion engine and connected with a sound deadening device, and the other end portion formed with a downstream open end positioned at a downstream side of the exhaust gas to discharge the exhaust gas to the atmosphere;

a diameter expansion structure formed on at least one of the exhaust gas upstream side and the exhaust gas downstream side of the exhaust gas pipe to be expanded in diameter toward one of the upstream open end and the downstream open end; and a reflection plate provided in the diameter expansion structure in opposing relationship with the discharge direction of the exhaust gas and having a single central open portion passing through the plate in the discharge direction of the exhaust gas and a closed portion closing the exhaust gas pipe, the plate being arranged to generate an open end reflection wave at the open portion and a closed end reflection wave at the closed portion in such a manner that the open end reflection wave and the closed end reflection wave interfere with each other.

2. The exhaust apparatus for the internal combustion engine as set forth in claim 1, in which the diameter expansion structure provided on at least one of the exhaust gas upstream side and the exhaust gas downstream side of the exhaust gas pipe and having an exponential shape expanded in diameter toward the open end to draw an exponential curve.

3. The exhaust apparatus for the internal combustion engine as set forth in claim 1, in which the opening area of the open portion is set at one third the total area of the open portion and the closed portion of the plate.

4. The exhaust apparatus for the internal combustion engine as set forth in claim 2, in which the opening area of the open portion is set at one third the total area of the open portion and the closed portion of the plate.

* * * * *